US006130017A

United States Patent [19]

Hayashi et al.

[11] Patent Number: 6,130,017

[45] Date of Patent: Oct. 10, 2000

[54] BLACK NON-MAGNETIC COMPOSITE PARTICLES FOR BLACK TONER AND BLACK TONER USING THE SAME

[75] Inventors: Kazuyuki Hayashi; Seiji Ishitani, both of Hiroshima; Yasuyuki Tanaka, Onoda; Hiroko Morii, Hiroshima, all of Japan

[73] Assignee: Toda Kogyo Corporation, Hiroshima-ken, Japan

[21] Appl. No.: 09/293,057

[22] Filed: Apr. 16, 1999

[30] Foreign Application Priority Data

Apr. 20, 1998 [JP] Japan ..... 10-126812

[51] Int. Cl.[7] ..... G03G 9/09

[52] U.S. Cl. ..... 430/106; 428/403

[58] Field of Search ..... 430/106, 106.6, 430/108; 428/138, 403, 404

[56] References Cited

U.S. PATENT DOCUMENTS

| | | | |
|---|---|---|---|
| 5,269,842 | 12/1993 | Katamoto | 106/457 |
| 5,604,071 | 2/1997 | Okado et al. | 430/110 |
| 5,688,852 | 11/1997 | Misawa et al. | 428/138 |
| 5,693,690 | 12/1997 | Hayashi et al. | 523/216 |
| 5,712,069 | 1/1998 | Baba et al. | 430/106.6 |

FOREIGN PATENT DOCUMENTS

| | | |
|---|---|---|
| 0453261A1 | 10/1991 | European Pat. Off. . |
| 0498942A1 | 8/1992 | European Pat. Off. . |
| 0523654A1 | 1/1993 | European Pat. Off. . |
| WO96/38768 | 12/1996 | WIPO . |

*Primary Examiner*—John Goodrow
*Attorney, Agent, or Firm*—Nixon & Vanderhye

[57] ABSTRACT

Black non-magnetic composite particles for black toner according to the present invention, comprise:

black hematite particles or black iron oxide hydroxide particles as core particles;

fine particles which are adhered or exist on at least a part of the surface of each magnetite particle, and comprise oxides, oxide hydroxides or oxides and oxide hydroxides composed of at least one element selected from the group consisting of Si, Zr, Ti, Al and Ce; and a methyl hydrogen polysiloxane coating layer formed on said fine particles or said fine particles and the exposed surface of the magnetite particle, the average particle size of said black non-magnetic composite particles being 0.08 to 1.0 $\mu$m.

Such black non-magnetic composite particles are suitable for a black toner which can exhibit not only an excellent flowability but also a high volume resistivity.

23 Claims, 4 Drawing Sheets

(×20000)

(×20000)

(×20000)

(×20000)

(×20000)

(×20000)

(×20000)

(×20000)

BLACK NON-MAGNETIC COMPOSITE PARTICLES FOR BLACK TONER AND BLACK TONER USING THE SAME

BACKGROUND OF THE INVENTION

The present invention relates to black non-magnetic composite particles for black toner and a black toner using the black non-magnetic composite particles, and more particularly, to black non-magnetic composite particles for black toner which can exhibit not only an excellent flowability but also a high volume resistivity capable of preventing the deterioration in charge amount of the black toner even when a large amount of the black non-magnetic composite particles are contained in the black toner, and a black toner using such black non-magnetic composite particles.

In conventional electrophotographic developing processes, a black toner prepared by mixing and dispersing non-magnetic black pigments such as carbon black in a binder resin, has been widely used as a developer. Recent developing systems have been generally classified into one-component developing methods and two-component developing methods.

In the two-component developing methods, the black toner and carrier are brought into frictional contact with each other to impart an electrostatic charge having a reverse sign to that of an electrostatic latent image to the black toner, so that the black toner is attached onto the surface of the electrostatic latent image due to an electrostatic attracting force therebetween, thereby neutralizing opposite electrostatic charges on the black toner and the electrostatic latent image.

On the other hand, in the one-component developing methods, since no carrier is used therein, it is not necessary to control a density of the black toner. Besides, a developing apparatus used therefor can be miniaturized due to its simple structure. However, since the one-component developing methods are inferior in developing performance or quality to the two-component developing methods, high techniques have now been required to obtain the same developing performance or quality as those of the two-component developing methods. As one of the one-component developing methods, there is known a so-called insulated non-black toner developing method using a high-resistant or insulated black toner prepared by dispersing carbon black fine particles in a binder resin without using magnetic particles.

In the case where the black toners used in the above two-component developing method and the insulated non-black toner developing method, are applied to a currently predominant PPC system of copiers, both types of the black toners are desired to exhibit a good insulating property or a high resistance, specifically to have a volume resistivity as high as not less than $10^{12}$ Ω·cm.

Also, it is known that the movement of a developer in a developing apparatus is strongly governed by the flowability thereof, for example, the flowability of the developer has strong influences on the frictional charging properties between the black toner and the carrier in the case of the two-component developing method, or on the charging property of the black toner on a sleeve in the case of the one-component developing method. Recently, with the enhancement in image quality such as image density, or tone gradation or in developing speed in the developing apparatus, it has been strongly demanded to increase the flowability of the black toner.

With the recent tendency of reducing a particle size of the black toner, it has been more strongly required to enhance the flowability thereof.

With respect to such a fact, in "Recent Electrophotographic Developing System and Comprehensive Data Collection for Development and Utilization of Toner Materials", published by Japan Scientific Information Co., Ltd. (1985), page 121, it has been described that " . . . , there is shown a relationship between image definitions obtained by using various toners. As is apparent from Table 1, the smaller the particle size of wet toner, the higher the image definition becomes. When a dry toner is used, it is also required to reduce the particle size of the toner for enhancing the image definition . . . . , it has been reported that by using toners having a particle size of 8.5 to 11 μm, fogs on a background area as well as toner consumption can be reduced. Further, it has been proposed that by using polyester-based toners having a particle size of 6 to 10 μm, an image quality, a charging stability and lifetime of the developer can be improved. However, when such toners having a small particle size are used, it has been required to solve many problems, e.g., those problems concerning productivity, sharpness of particle size distribution, improvement in flowability, . . . etc.".

Also, the insulated or high-resistance black toner has been required to show a high blackness and a high image density of line images and solid area images on copies.

With respect to this fact, on page 272 of the above-mentioned "Recent Electrophotographic Developing System and Comprehensive Data Collection for Development and Utilization of Toner Materials", it has been described that "Powder development is characterized by a high image density. However, the image density as well as the fog density as described hereinafter, have strong influences on image characteristics".

Further, it is necessary that the insulated or high-resistance black toners can retain a sufficient charge required for the development of latent images. Therefore, it has been strongly desired that the insulated or high-resistance black toners has a volume resistivity as high as not less than $10^{12}$ Ω·cm, as described above.

With respect to this fact, on page 266 of the above-mentioned literature "Recent Electrophotographic Developing System and Comprehensive Data Collection for Development and Utilization of Toner Materials" (1985), it has been described that "When the charge amount is low, the attraction force between toner and carrier is weakened, so that the toner is separated and scattered around due to agitation in a developing zone, mechanical impact against a photosensitive member, etc., resulting in causing a so-called "fogging". Conversely, when the charge amount is too high, the toner remains attached onto the carrier, so that the amount of the toner transferred to the photosensitive member is reduced, resulting in deteriorated image density. FIG. 1 shows a Thompson's diagram showing a relationship between charge amount and image quality. . . . In general, the volume resistivity is required to be not less than $10^{12}$ Ω·cm (in the case of insulated toners)".

As described above, it has been strongly desired to enhance various properties of the black toner. It is known that the black toner, especially black pigments contained in the black toner or exposed to the surface of the black toner, have large influences on developing characteristics. There is a close relationship between properties of the black toner and those of the black pigments mixed and dispersed in the black toner.

That is, since the flowability of the black toner largely depends upon surface conditions of a black pigment exposed to the surface of the black toner, it has been strongly desired that the black pigment itself can show an excellent flowability. The blackness and density of the black toner also largely depend upon those of the black pigment contained in the black toner. The larger the content of the black pigment, the higher the blackness of the black toner becomes. As described above, the insulated or high-resistance black toner is required to show an insulating property to such an extent capable of retaining a necessary charge amount, especially have a volume resistivity as high as not less than $10^{12}$ Ω·cm. Further, in order to enhance the blackness of the black toner, it has been strongly desired to prevent the charge amount of the black toner from being deteriorated even when a large amount of the black pigment is contained in the black toner.

Namely, in order to obtain a black toner having a volume resistivity as high as possible, it has been strongly desired to increase a volume resistivity of the black pigment as highly as possible.

At present, as the black pigment for the black toner, there has been mainly used carbon black fine particles (Japanese Patent Application Laid-Open (KOKAI) Nos. 4-142561 (1992) and 10-39546(1998)).

Thus, it has been most strongly demanded to provide a black pigment for black toner which have not only an excellent flowability but also a high volume resistivity capable of preventing a charge amount of the black toner from being deteriorated even when a large amount of the black pigment is contained in the black toner. However, black pigment which can satisfy such properties has not been obtained yet.

That is, in the case where the above-mentioned conventional carbon black fine particles are used as a black pigment for black toner, in order to produce a black toner having a volume resistivity as high as not less than $10^{12}$ Ω·cm, it is required that the amount of the carbon black fine particles used therein is restricted because the carbon black fine particles exhibit an electrical conductivity. As a result, there arises such a problem that the obtained black toner shows neither a sufficient blackness nor a sufficient flowability.

Further, it has been pointed out that the carbon black fine particles have problems concerning safety and hygiene. These facts are explained below.

The carbon black fine particles themselves are a conductive material having a volume resistivity as low as not more than 10 Ω·cm. Therefore, when the carbon black fine particles are used in a large amount in order to enhance a blackness of the black toner, the volume resistivity of the obtained black toner is reduced, so that the toner can be no longer used as an insulated or high-resistance toner. On the contrary, when the amount of the carbon black fine particles used is reduced from the standpoint of a high volume resistivity, the carbon black fine particles tend to be buried within each black toner particle since the carbon black fine particles have an average particle size as fine as 0.010 to 0.060 μm. As a result, the amount of the carbon black fine particles exposed to the surface of each black toner particle is considerably reduced, so that there arises a problem that the obtained toner is deteriorated in flowability.

Further, since the specific gravity of the carbon black fine particles is extremely low, i.e., as low as 1.80 to 1.85, the carbon black fine particles are deteriorated in handling property. In addition, when the black toner is prepared by dispersing such carbon black fine particles in a binder resin, the bulk specific gravity of the obtained black toner becomes considerably low. Therefore, the obtained toner tends to be scattered around, and deteriorated in flowability.

Furthermore, it has been reported that substances having possible carcinorgen which are produced in the course of production of the carbon black fine particles, are disadvantageously incorporated as impurities in the carbon black fine particles. Thus, it has been pointed out that the black toner using such carbon black fine particles has a problem concerning safety.

As a result of the present inventor's earnest studies for solving the above problems, it has been found that by adhering oxide fine particles and/or oxide hydroxide fine particles comprising at least one element selected from the group consisting of Si, Zr, Ti, Al and Ce, onto the surfaces of black hematite particles or black iron oxide hydroxide particles as core particles, and then coating the fine particles or the fine particles and the exposed surface of the core particles, with methyl hydrogen polysiloxane, the obtained black non-magnetic composite particles can show not only an excellent flowability but also a high volume resistivity. The present invention has been attained on the basis of the finding.

SUMMARY OF THE INVENTION

It is an object of the present invention to provide black non-magnetic composite particles which can show not only an excellent flowability but also a high volume resistivity capable of preventing the deterioration in charge amount of the black toner even when a large amount of the black non-magnetic composite particles are contained in the black toner.

It is an another object of the present invention to provide a black toner which can show not only an excellent flowability but also a high volume resistivity.

To accomplish the aims, in a first aspect of the present invention, there is provided black non-magnetic composite particles for black toner, which comprise black hematite particles or black iron oxide hydroxide particles as core particles, fine particles which are adhered or exist on at least a part of the surface of each black hematite particle or black iron oxide hydroxide particle as a core particle and which comprise oxides and/or oxide hydroxides of at least one element selected from the group consisting of Si, Zr, Ti, Al and Ce, and a methyl hydrogen polysiloxane coating layer formed on the fine particles or the fine particles and the exposed surface of each black hematite particle or black iron oxide hydroxide particle as core particle; and which have an average particle size of 0.08 to 1.0 μm.

In a second aspect of the present invention, there are provided black non-magnetic composite particles for black toner, comprising:

black hematite particles or black iron oxide hydroxide particles as core particles, wherein at least a part of the surface of said black hematite particle or black iron oxide hydroxide particle as a core particle is coated with at least one compound selected from the group consisting of hydroxides of aluminum, oxides of aluminum, hydroxides of silicon and oxides of silicon;

fine particles which are adhered or exist on at least a part of the surface of the coat composed of at least one compound selected from the group consisting of hydroxides of aluminum, oxides of aluminum, hydroxides of silicon and oxides of silicon or the surface of the coat composed of at least one compound selected from the group consisting of hydroxides of aluminum, oxides of aluminum, hydroxides of silicon and oxides of silicon and the exposed surface of each black hematite particle or black iron oxide hydroxide particle as a core particle, and which comprise oxides, oxide hydroxides or oxides and oxide hydroxides composed of at least one element selected from the group consisting of Si, Zr, Ti, Al and Ce; and a methyl hydrogen polysiloxane coating layer formed on said fine particles or said fine particles and the exposed surface of at least one compound selected from the group consisting of hydroxides of aluminum, oxides of aluminum, hydroxides of silicon and oxides of silicon and the black hematite particle or black iron oxide hydroxide particles as core particle, the average particle size of said black non-magnetic composite particles being 0.08 to 1.0 $\mu$m In a third aspect of the present invention, there is provided a black toner comprising composite particles which comprise:

black non-magnetic composite particles, comprising black hematite particles or black iron oxide hydroxide particles as core particles, fine particles which are adhered or exist on at least a part of the surface of each black hematite particle or black iron oxide hydroxide particle as a core particle, and comprise oxides, oxide hydroxides or oxides and oxide hydroxides composed of at least one element selected from the group consisting of Si, Zr, Ti, Al and Ce, and a methyl hydrogen polysiloxane coating layer formed on said fine particles or said fine particles and the exposed surface of the black hematite particle or black iron oxide hydroxide particle as a core particle, the average particle size of said black non-magnetic composite particles being 0.08 to 1.0 $\mu$m; and a binder resin.

In a fourth aspect of the present invention, there is provided a black toner comprising composite particles which comprise:

black non-magnetic composite particles, comprising black hematite particles or black iron oxide hydroxide particles as core particles, wherein at least a part of the surface of said black hematite particle or black iron oxide hydroxide particle as a core particle is coated with at least one compound selected from the group consisting of hydroxides of aluminum, oxides of aluminum, hydroxides of silicon and oxides of silicon, fine particles which are adhered or exist on at least a part of the surface of the coat composed of at least one compound selected from the group consisting of hydroxides of aluminum, oxides of aluminum, hydroxides of silicon and oxides of silicon or the surface of the coat composed of at least one compound selected from the group consisting of hydroxides of aluminum, oxides of aluminum, hydroxides of silicon and oxides of silicon and the exposed surface of each black hematite particle or black iron oxide hydroxide particle as a core particle, and which comprise oxides, oxide hydroxides or oxides and oxide hydroxides composed of at least one element selected from the group consisting of Si, Zr, Ti, Al and Ce, and a methyl hydrogen polysiloxane coating layer formed on said fine particles or said fine particles and the exposed surface of at least one compound selected from the group consisting of hydroxides of aluminum, oxides of aluminum, hydroxides of silicon and oxides of silicon and the black hematite particle or black iron oxide hydroxide particles as core particle, the average particle size of said black non-magnetic composite particles being 0.08 to 1.0 $\mu$m; and a binder resin.

In a fifth aspect of the present invention, there is provided a black toner comprising composite particles which comprise:

the black non-magnetic composite particles set forth in the first or second aspect; and a binder resin, the black non-magnetic composite particles existing inside the composite particle and at least a part of the black non-magnetic composite particles being exposed to the surface of the composite particle.

In a sixth aspect of the present invention, there is provided a black toner comprising composite particles which comprise:

the black non-magnetic composite particles set forth in the first or second aspect; and a binder resin, the black non-magnetic composite particles being existing in the surface of the composite particle.

In s seventh aspect of the present invention, there is provided a black toner comprising composite particles which comprise:

the black non-magnetic composite particles set forth in the first or second aspect; and a binder resin, the black non-magnetic composite particles existing inside the composite particle wherein at least a part of said black non-magnetic composite particles is exposed to the surface of the composite particle, and a part of the black non-magnetic composite particles existing in the surface of the composite particle.

DETAILED DESCRIPTION OF THE INVENTION

Figure 1:
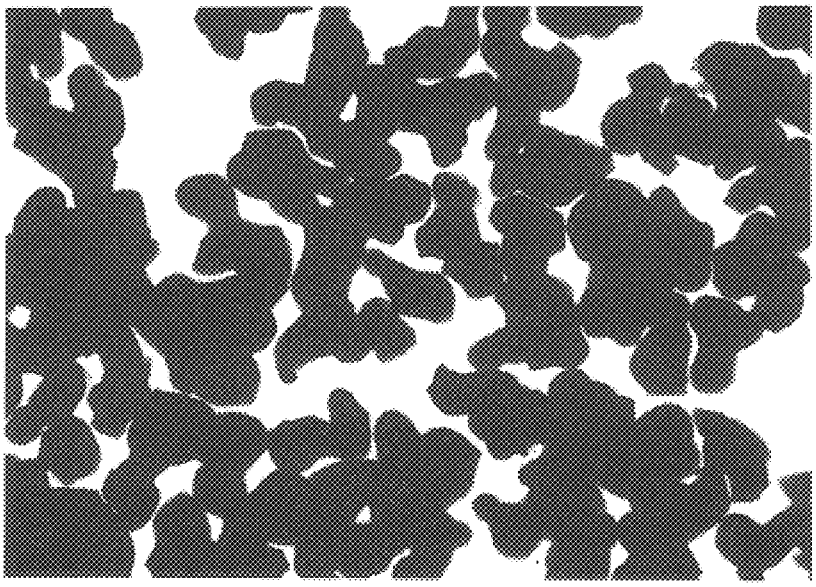
FIG. 1 is an electron micrograph (×20,000) showing a particle structure of granular Mn-containing hematite particles used in Example 1.

The present invention is now described in detail below.

First, the black non-magnetic composite particles according to the present invention are described.

As core particles of the black non-magnetic composite particles according to the present invention, black hematite particles and/or iron oxide hydroxide particles are used.

As the black hematite particles, there may be exemplified manganese-containing hematite particles which contain manganese in an amount of 5 to 40% by weight, preferably 5 to 35% by weight (calculated as Mn) based on the weight of the manganese-containing hematite particles. As the black iron oxide hydroxide particles, there may be exemplified manganese-containing iron oxide hydroxide particles such as manganese-containing goethite particles, which contain manganese in an amount of 5 to 40% by weight, preferably 5 to 35% by weight (calculated as Mn) based on the weight of the manganese-containing iron oxide hydroxide particles.

In the consideration of blackness of the obtained black non-magnetic composite particles, black hematite particles are preferred.

As the core particles used in the present invention, there may be exemplified isotropic particles having a ratio of average maximum diameter to average minimum diameter (hereinafter referred to merely as "sphericity") of less than 2.0:1, such as spherical particles, octahedral particles or hexahedral particles; or anisotropic particles having a ratio of average major axis diameter to average minor axis diameter (hereinafter referred to merely as "aspect ratio") of not less than 2.0:1, such as acicular particles, spindle-shaped particles or rice ball-like particles. In the consideration of the flowability of the obtained black non-magnetic composite particles, the isotropic particles are preferred. Among them, granular Mn-containing hematite particles having a sphericity of 1.0:1 to 1.5:1 are more preferred.

The upper limit of the aspect ratio of the anisotropic particles is preferably 20.0:1, more preferably 18.0:1, still more preferably 15.0:1. When the aspect ratio of the anisotropic particles is more than 20.0:1, the obtained black non-magnetic composite particles are frequently entangled or intertwined with each other, so that the dispersibility of these particles in a binder resin upon the production of the black toner tends to be deteriorated.

The core particles used in the present invention, have an average particle size (an average major axis diameter in the case of anisotropic particles) of usually 0.055 to 0.95 $\mu$m, preferably 0.065 to 0.75 $\mu$m, more preferably 0.065 to 0.45 $\mu$m.

When the average particle size of the core particles is more than 0.95 $\mu$m, the obtained black non-magnetic composite particles become coarse, so that the tinting strength thereof is deteriorated. On the other hand, when the average particle size of the core particles is less than 0.055 $\mu$m, the obtained black non-magnetic composite particles becomes too fine, so that the dispersibility of black non-magnetic composite particles in a binder resin upon the production of the black toner tends to be deteriorated.

As to the particle size distribution of the core particles, the geometrical standard deviation value thereof is preferably 1.01 to 2.0, more preferably 1.01 to 1.8, still more preferably 1.01 to 1.6. When the geometrical standard deviation value thereof is more than 2.0, coarse particles are contained therein, so that the particles are inhibited from being uniformly dispersed. As a result, it also becomes difficult to uniformly adhere the oxide fine particles and/or the oxide hydroxide fine particles onto the surface of each core particle, and to form a uniform coating layer composed of methyl hydrogen polysiloxane thereon. It is industrially difficult to obtain particles having a geometrical standard deviation value of less than 1.01.

The BET specific surface area of the core particles thereof is not less than 0.5 $m^2/g$. When the BET specific surface area thereof is less than 0.5 $m^2/g$, the core particles may become coarse particles, or the sintering between the particles may be caused, so that the obtained black non-magnetic composite particles also may become coarse particles and tend to be deteriorated in tinting strength. In the consideration of the tinting strength of the obtained black non-magnetic composite particles, the BET specific surface area of the core particles is preferably not less than 1.0 $m^2/g$, more preferably not less than 3.0 $m^2/g$. The upper limit of the BET specific surface area of the core particles, is usually 90 $m^2/g$. Further, in the consideration of the dispersibility of the black non-magnetic composite particles in the binder resin upon the production of the black toner, the upper limit of the BET specific surface area of the core particles, is preferably 70 $m^2/g$, more preferably 50 $m^2/g$.

As to the flowability of the core particles, the fluidity index thereof is about 25 to about 43. Among the core particles having various shapes, the granular Mn-containing hematite particles are excellent in flowability, for example, the fluidity index thereof is about 30 to about 43.

As to the blackness of the core particles, in the case of the granular Mn-containing hematite particles, the lower limit thereof is usually 18.0 when represented by L* value, and the upper limit thereof is usually 28.0, preferably 25.0 when represented by L* value.

In the case of the Mn-containing iron oxide hydroxide particles such as Mn-containing goethite particles, the lower limit thereof is usually more than 18.0 when represented by L* value, and the upper limit thereof is usually 30.0, preferably 28.0 when represented by L* value.

When the L* value exceeds 30, the lightness of the particles is increased, so that it is difficult to obtain black non-magnetic composite particles having a sufficient blackness.

The volume resistivity of the core particles is usually about $5.0\times10^6$ Ω·cm to about $8.0\times10^7$ Ω·cm.

As the oxide fine particles and/or the oxide hydroxide fine particles existing between at least a part of the surface of each core particle and the coating layer composed of methyl hydrogen polysiloxane, there can be used such fine particles capable of uniformly adhering or existing onto the surface of each core particle without deteriorating the blackness thereof, i.e., non-magnetic or paramagnetic fine particles which are transparent and free from being magnetically agglomerated. As such fine particles, there may be exemplified fine particles composed of an oxide and/or an oxide hydroxide of at least one element selected from the group consisting of Si, Zr, Ti, Al and Ce (hereinafter referred to merely as "fine particles").

As such fine particles, there may be used synthesized products or commercially available colloid solutions containing fine particles. As the commercially available colloid solutions containing fine particles, there may be exemplified those colloid solutions containing fine particles composed of silicon dioxide, zirconium oxide, zirconium oxide hydroxide, titanium dioxide, aluminum oxide, hydrated alumina, cerium dioxide or the like.

The average particle size of the fine particles is usually 0.001 to 0.05 $\mu$m, preferably 0.002 to 0.045 $\mu$m.

When the average particle size of the fine particles is less than 0.001 μm, appropriate irregularities cannot be formed on the surfaces of the obtained black non-magnetic composite particles due to too much fineness of the fine particles, so that the flowability of the black non-magnetic composite particles cannot be sufficiently improved.

Further, the intermolecular force between the fine particles is increased due to too much fineness thereof, resulting in the deterioration in dispersibility in the core particles. As a result, it becomes difficult to obtain black non-magnetic composite particles on the surfaces of which the fine particles are uniformly adhered or exist.

On the other hand, when the average particle size of the fine particles is more than 0.05 μm, the particle size of the fine particles becomes too larger as compared to that of the core particles, so that there is a tendency that the fine particles cannot be sufficiently adhered onto the surfaces of the core particles.

The ratio of the average particle size of the core particles to that of the fine particles is preferably not less than 2:1, more preferably not less than 5:1. When the ratio is less than 2:1, the particle size of the fine particles becomes too larger as compared to that of the core particles, so that there is a tendency that the fine particles cannot be sufficiently adhered onto the surfaces of the core particles. The upper limit thereof is preferably 100:1.

The amount of the fine particles adhered or existing on at least a part of the surface of each core particle is usually 0.5 to 50% by weight, preferably 1.0 to 45% by weight (calculated as $SiO_2$, $ZrO_2$, $TiO_2$, $Al_2O_3$ or $CeO_2$) based on the weight of the core particles.

When the amount of the fine particles is less than 0.5% by weight, the obtained black non-magnetic composite particles cannot show a sufficient flowability due to the lack of amount of the fine particles adhered or existing on the surface of each core particle.

On the other hand, when the amount of the fine particles is more than 50% by weight, the obtained black non-magnetic composite particles can show a sufficient flowability. However, the fine particles tend to be fallen-off or desorbed from the surfaces of the black non-magnetic composite particles, so that the dispersibility of the black non-magnetic composite particles in a binder resin is deteriorated upon the production of black toner.

It is known that the fine particles can be charged to various negative or positive potentials according to kinds thereof. Therefore, the kind of fine particles adhered or existing on the surfaces of the core particles, may be appropriately selected according to charging property of the obtained black toner.

The methyl hydrogen polysiloxane used in the present invention, is represented by the following general formula:

$$(CH_3HSiO)_n((CH_3)_3Sio_{1/2})_2$$

wherein n is 10 to 830.

Thus, the methyl hydrogen polysiloxane has an Si—H reactive group within its molecule. Since the methyl hydrogen polysiloxane exhibits a transparency, the blackness of the core particles can be prevented from being adversely affected thereby, so that the obtained black non-magnetic composite particles can show substantially the same blackness as that of the core particles.

In the consideration of forming a uniform coating layer composed of the methyl hydrogen polysiloxane, the "n" in the above general formula is preferably 14 to 450, more preferably 20 to 325. Specific examples of the methyl hydrogen polysiloxane may include commercially available products such as TSF484 (molecular weight: about 3,500) and TSF483 (molecular weight: about 9,200) (tradenames; both produced by Toshiba Silicone Co., Ltd.), or the like.

The coating amount of methyl hydrogen polysiloxane is preferably 0.1 to 50% by weight, more preferably 0.2 to 40% by weight, still more preferably 0.5 to 30% by weight (calculated as $SiO_2$) based on the weight of the core particles on the surfaces of which the fine particles are adhered or exist.

When the coating amount of methyl hydrogen polysiloxane is less than 0.1% by weight, the core particles on the surfaces of which the fine particles are adhered or exist, cannot be sufficiently coated with the methyl hydrogen polysiloxane, so that the fine particles tend to be fallen-off or desorbed from the surfaces of the core particles, thereby failing to obtain a black toner having an excellent flowability. Further, the fine particles which are not coated with methyl hydrogen polysiloxane, are exposed to the surface of the composite particle, resulting in reduction in volume resistivity of the obtained black toner.

On the other hand, when the coating amount of methyl hydrogen polysiloxane is more than 50% by weight, clear irregularities cannot be formed on the surfaces of the black non-magnetic composite particles, so that the flowability of the obtained black toner is deteriorated. Further, since the effect of increasing the volume resistivity is already saturated, the use of such a large coating amount of methyl hydrogen polysiloxane is meaningless.

The particle shape and particle size of the black non-magnetic composite particles according to the present invention are considerably varied depending upon those of the core particles. The black non-magnetic composite particles have a similar particle shape to that of the core particle, and a slightly larger particle size than that of the core particles.

More specifically, the obtained black non-magnetic composite particles according to the present invention, have an average particle size in the case of the isotropic particles (average major axis diameter in case of anisotropic core particles), of usually 0.06 to 1.0 μm, preferably 0.07 to 0.8 μm, more preferably 0.07 to 0.5 μm When the isotropic particles are used as core particles, the sphericity of the obtained black non-magnetic composite particles according to the present invention, is usually 1.0:1 to 1.5:1.

When the anisotropic particles are used as core particles, the upper limit of the aspect ratio of the obtained black non-magnetic composite particles according to the present invention, is usually 20.0:1, preferably 18.0:1, more preferably 15.0:1.

The geometrical standard deviation value of the black non-magnetic composite particles according to the present invention is preferably not more than 2.0, more preferably 1.01 to 1.8, still more preferably 1.01 to 1.6. The lower limit of the geometrical standard deviation value thereof is preferably 1.01. When the geometrical standard deviation value thereof is more than 2.0, the tinting strength of the black non-magnetic composite particles is likely to be deteriorated due to the existence of coarse particles therein. It is industrially difficult to obtain such particles having a geometrical standard deviation of less than 1.01.

The BET specific surface area of the black non-magnetic composite particles according to the present invention, is usually not less than 0.5 $m^2/g$, preferably not less than 1.0 $m^2/g$, more preferably not less than 3.0 $m^2/g$. When the BET specific surface area thereof is less than 0.5 $m^2/g$, the obtained black non-magnetic composite particles may be coarse, and the sintering between the black non-magnetic composite particles is caused, thereby deteriorating the tinting strength. The upper limit thereof is usually 100 $m^2/g$. When the BET specific surface area is more than 100 $m^2/g$, the black non-magnetic composite particles tend to be agglomerated together by the increase in intermolecular force due to the reduction in particle size, thereby deteriorating the dispersibility in a binder resin upon production of the black toner. In the consideration of the dispersibility in a binder resin upon production of the black toner, the upper limit is preferably 90 $m^2/g$, more preferably 80 $m^2/g$.

As to the flowability of the black non-magnetic composite particles, the fluidity index thereof is preferably 47 to 80, more preferably 48 to 80, still more preferably 49 to 80. In the case of the black non-magnetic composite particles whose surfaces are coated with hydroxides of aluminum or the like, the fluidity index thereof is preferably 49 to 80, more preferably 50 to 80, still more preferably 51 to 80. When the fluidity index is less than 47, the flowability of the obtained black non-magnetic composite particles is insufficient, and there arise disadvantages such as clogging of hoppers during the production process, resulting in poor handling property.

In the case of the black Mn-containing hematite particles as the core particles, the lower limit of the blackness of the black non-magnetic composite particles is usually 18.0 when represented by L* value, and the upper limit thereof is usually 28.0, preferably 26.0 when represented by L* value.

In the case of the black Mn-containing iron oxide hydroxide particles such as the Mn-containing goethite particles, the lower limit of the blackness thereof is usually more than 18.0 when represented by L* value, and the upper limit thereof is usually 30.0, preferably 28.0 when represented by L* value.

When the L* value exceeds the above-mentioned upper limit, the lightness of the particles is increased, so that it is difficult to obtain black non-magnetic composite particles having a sufficient blackness.

The volume resistivity of the black non-magnetic composite particles is usually not less than $1.0\times10^8$ Ω·cm, preferably about $5.0\times10^8$ Ω·cm to about $5.0\times10^{11}$ Ω·cm. When the volume resistivity of the black non-magnetic composite particles is less than $1.0\times10^8$ Ω·cm, the obtained black toner is disadvantageously deteriorated in volume resistivity.

The dispersibility of the black non-magnetic composite particles is not less than 4, more preferably 5 when evaluated by the 5-rank evaluation method described in detail hereinafter.

In the black non-magnetic composite particles according to the present invention, at least a part of the surface of the core particle may be preliminarily coated with at least one compound selected from the group consisting of hydroxides of aluminum, oxides of aluminum, hydroxides of silicon and oxides of silicon (hereinafter referred to as "coating composed of hydroxides and/or oxides of aluminum and/or silicon"). In this case, the obtained black non-magnetic composite particles can show a more excellent flowability as compared to in the case where the core particles are uncoated with hydroxides and/or oxides of aluminum and/or silicon, because the fine particles are more uniformly adhered on at least a part of the surface of the core particle.

The coating amount of the hydroxides and/or oxides of aluminum and/or silicon is preferably 0.01 to 50% by weight (calculated as Al, $SiO_2$ or a sum of Al and $SiO_2$) based on the weight of the core particles.

When the coating amount of the hydroxides and/or oxides of aluminum and/or silicon is less than 0.01% by weight, the effect of enhancing the flowability of the obtained black non-magnetic composite particles may not be obtained.

On the other hand, when the coating amount of the hydroxides and/or oxides of aluminum and/or silicon is more than 50% by weight, the obtained black non-magnetic composite particles can exhibit a good flowability. However, the use of such unnecessarily large coating amount of the hydroxides and/or oxides of aluminum and/or silicon is meaningless.

The particle size, geometrical standard deviation, BET specific surface area, blackness L* value, and volume resistivity of the black non-magnetic composite particles wherein at least a part of the surface of the core particle is coated with the hydroxides and/or oxides of aluminum and/or silicon according to the present invention, are substantially the same as those of the black non-magnetic composite particles wherein the core particle is uncoated with the hydroxides and/or oxides of aluminum and/or silicon according to the present invention. In addition, the above-metioned black non-magnetic composite particles have a more improved flowability.

Next, the black toner according to the present invention is described.

The black toner according to the present invention comprises composite particles comprising the black non-magnetic composite particles and a binder resin. The composite particles may further contain a mold release agent, a colorant, a charge-controlling agent and other additives, if necessary.

The composite particles according to the present invention have an average particle size of usually 3 to 25 μm, preferably 4 to 18 μm, more preferably 5 to 15 μm.

As to the composite particles for black toner according to the present invention, there may be exemplified:

- composite particles (1) wherein the black non-magnetic composite particles exist (are contained) inside the composite particle in which at least a part of the black non-magnetic composite particles contained therein is exposed to the surface of the composite particle (forms a part of the surface of the composite particle);
- composite particles (2) wherein the black non-magnetic composite particles are exist in and/or adhered on the surface of the composite particle (form at least a part of the surface of the composite particle), and carbon black fine particles may exist (are contained) inside the composite particle;
- composite particles (3) wherein a part of the black non-magnetic composite particles exists (is contained) inside the composite particle in which at least a part of the black non-magnetic composite particles contained therein is exposed to the surface of the composite particle (forms a part of the surface of the composite particle), and a part of the black non-magnetic composite particles exists in and/or is adhered on the surface of the composite particle (forms at least a part of the surface of the composite particle); and
- a mixed particles composed of at least two of the composite particles (1), (2) and (3).

The composite particles according to the present invention may further contain and/or have carbon black fine particles or the like in addition to the black non-magnetic composite particles according to the present invention, in such an amount as not to deteriorate properties of the obtained composite particles.

In the composite particles (1) for black toner, the amount of the binder resin used is usually 200 to 3,500 parts by weight, preferably 300 to 2,000 parts by weight based on 100 parts by weight of the black non-magnetic composite particles. When the amount of the binder resin used is less than 50 parts by weight, a mixture of the black non-magnetic composite particles and the binder resin cannot be sufficiently kneaded together due to too small amount of the binder resin relative to that of the black non-magnetic composite particles, thereby failing to obtain good composite particles. On the other hand, when the amount of the binder resin is more than 800 parts by weight, the tinting strength of the composite particles is deteriorated because the amount of the binder resin is too large relative to that of the black non-magnetic composite particles, thereby reducing the amount of the black non-magnetic composite particles which are exposed to the surface of the composite particle. Alternatively, the amount of the black non-magnetic composite particles used is preferably 2 to 30% by weight, more preferably 4 to 20% by weight based on the weight of the composite particles (1).

Alternatively, in the composite particles (1), even though among 100 parts by weight of the black non-magnetic composite particles, less than 50 parts by weight, preferably not more than 45 parts by weight, more preferably not more than 40 parts by weight of the black non-magnetic composite particles are substituted with carbon black fine particles or the like, the aimed black toner can also be obtained.

In the composite particles (2) for black toner, the amount of the black non-magnetic composite particles used is usually 0.1 to 9.0 parts by weight, preferably 0.5 to 5.0 parts by weight based on 100 parts by weight of the composite particles (2). When the amount of black non-magnetic composite particles used is less than 0.1 part by weight, the flowability of the obtained black toner cannot be improved. On the other hand, when the amount of the black non-magnetic composite particles used is more than 10 parts by weight, since the effect of improving the flowability is already saturated, the use of such a large amount of the black non-magnetic composite particles is meaningless.

In the composite particles (2), the carbon black fine particles or the like may be contained in amount of the preferably 2 to 30% by weight more preferably 4 to 20% by weight based on the weight of the composite particles (2) wherein the carbon black fine particles or the like are contained therewithin.

In the composite particles (3) for black toner, the amount of the black non-magnetic composite particles contained therein is substantially the same as that used in the above-mentioned composite particles (1) and the amount of the black non-magnetic composite particles adhered and/or existing on the surfaces thereof is substantially the same as that used in the above-mentioned composite particles (2). Further, a part of the black non-magnetic composite particles may be substituted with the same amount of the carbon black fine particles or the like as that used in each composite particles (1) and (2).

As the binder resins, there may be used vinyl-based polymers, i.e., homopolymers or copolymers of vinyl-based monomers such as styrene, alkyl acrylates and alkyl methacrylates. As the styrene monomers, there may be exemplified styrene and substituted styrenes. As the alkyl acrylate monomers, there may be exemplified acrylic acid, methyl acrylate, ethyl acrylate, butyl acrylate or the like.

It is preferred that the above copolymers contain styrene-based components in an amount of usually 50 to 95% by weight.

In the binder resin used in the present invention, the above-mentioned vinyl-based polymers may be used in combination with polyester-based resins, epoxy-based resins, polyurethane-based resins or the like, if necessary.

As to the flowability of the black toner according to the present invention, the fluidity index thereof is usually 70 to 100, preferably 75 to 100. Especially, in the case where the black toner are composed of such composite particles (3) within which the black non-magnetic composite particles exist and on the surfaces of which the black non-magnetic composite particles are adhered and/or exist, the obtained black toner can show a more excellent flowability, i.e., a fluidity index of 80 to 100. When the fluidity index is less than 70, the flowability of the obtained black toner becomes insufficient.

The blackness of the black toner according to the present invention is usually not more than 40.0, preferably not more than 35.0, more preferably not more than 30.0 when represented by L* value. When the blackness thereof is more than 40.0, the lightness of the black toner may be increased, resulting in insufficient blackness. The lower limit of the blackness of the black toner is usually about 16.0 when represented by L* value.

The black toner according to the present invention, exhibits a volume resistivity of usually not less than $1.0\times10^{13}$ Ω·cm, preferably not less than $1.0\times10^{14}$ Ω·cm. In particular, in the case where the black toner according to the present invention are composed of such composite particles (3) within which the black non-magnetic composite particles exist and on the surfaces of which the black non-magnetic composite particles are adhered and/or exist, the obtained black toner can show a higher volume resistivity, i.e., preferably not less than $5.0\times10^{14}$ Ω·cm. When the volume resistivity of the black toner is less than $1.0\times10^{13}$ Ω·cm, the charge amount of the black toner tend to be varied according to environmental conditions upon use of the toner, so that the characteristics thereof becomes unstable. The volume resistivity of the black toner is preferably less than $10^{17}$ Ω·cm.

The black non-magnetic composite particles according to the present invention can be produced by the following method.

The granular Mn-containing hematite particles as the isotropic core particles used in the present invention, can be produced by heating, in air at a temperature of 750 to 1,000° C., (a) coated core particles which are obtained by first producing granular core particles by a so-called wet oxidation method, i.e., by passing an oxygen-containing gas through a suspension containing a ferrous hydroxide colloid obtained by reacting an aqueous ferrous salt solution with alkali hydroxide, and then coating the obtained granular core particles with a manganese compound in an amount of 8 to 150 atm % (calculated as Mn) based on whole Fe, or (b) core particles containing manganese in an amount of 8 to 150 atm % (calculated as Mn) based on whole Fe, which are obtained by conducting the above wet oxidation method in the presence of manganese. In the consideration of blackness of the obtained manganese-containing hematite particles, it is preferred to use the manganese-containing core particles (b). (Refer to Japanese Patent Application Laid-open (KOKAI) No. 4-144924).

The acicular or spindle-shaped Mn-containing hematite particles as the anisotropic core particles used in the present invention, can be produced by heat-dehydrating acicular or spindle-shaped iron oxide hydroxide particles containing manganese in an amount of 8 to 150 atm % (calculated as Mn) based on the whole Fe, obtained by the method described hereinafter, in air at a temperature of 400 to 800° C.

The acicular or spindle-shaped iron oxide hydroxide particles as the anisotropic core particles used in the present invention, can be produced by passing an oxygen-containing gas through a suspension containing either ferrous hydroxide colloid, iron carbonate or iron-containing precipitates obtained by reacting an aqueous ferrous salt solution with alkali hydroxide, alkali carbonate or both of alkali hydroxide and alkali carbonatein the presence of manganese in an amount of 8 to 150 atm % (calculated as Mn) based on the whole Fe. (Refer to Japanese Patent Application Laid-open (KOKAI) Nos. 6-263449 and 8-259237)

The adhesion or deposition of the fine particles on the surfaces of the core particles may be conducted by mechanically mixing and stirring core particles together with a colloid solution containing fine particles composed of an oxide or an oxide hydroxide of Si, Zr, Ti, Al or Ce, and then drying the obtained particles.

As the colloid solution containing silicon oxide fine particles or silicon oxide hydroxide fine particles, there may be exemplified Snowtex-XS, Snowtex-SS, Snowtex-UP, Snowtex-20, Snowtex-30, Snowtex-40, Snowtex-C, Snowtex-N, Snowtex-O, Snowtex-S, Snowtex-20L, Snowtex-OL (tradenames, produced by Nissan Kagaku Kogyo, Co., Ltd.) or the like. In the consideration of the effect of improving the flowability of the obtained black non-magnetic composite particles, Snowtex-XS, Snowtex-SS and Snowtex-UP are preferred.

As the colloid solution containing zirconium oxide fine particles or zirconium oxide hydroxide fine particles, there may be exemplified NZS-20A, NZS-30A, NZS-30B (tradenames, produced by Nissan Kagaku Kogyo, Co., Ltd.) or the like.

As the colloid solution containing titanium oxide fine particles or titanium oxide hydroxide fine particles, there may be exemplified STS-01, STS-02 (tradenames, produced by Ishihara Sangyo, Co., Ltd.) or the like.

As the colloid solution containing aluminum oxide fine particles or aluminum oxide hydroxide fine particles, there may be exemplified AS-100, AS-200, AS-520 (tradenames, produced by Nissan Kagaku Kogyo, Co., Ltd.) or the like.

As the colloid solution containing cerium oxide fine particles or cerium oxide hydroxide fine particles, there may be exemplified a solution of Ceria-sol (produced by Nissan Kagaku Kogyo, Co., Ltd.) or the like.

The amount of the fine particles contained in the colloid solution added, is preferably 0.5 to 50% by weight (calculated as $SiO_2$, $ZrO_2$, $TiO_2$, $Al_2O_3$ or $CeO_2$) based on the weight of the core particles. When the amount of the fine particles added is less than 0.5% by weight, the amount of the fine particles existing in the core particles is insufficient, so that it is difficult to sufficiently enhance the flowability of the obtained black non-magnetic composite particles. On the other hand, when the amount of the fine particles added is more than 50% by weight, although the flowability of the obtained black non-magnetic composite particles can be improved sufficiently, the fine particles tend to be fallen-off or desorbed from the surfaces of the core particles, so that the dispersibility of the black non-magnetic composite particles in binder resin is sometimes deteriorated upon production of the black toner.

In order to cause the fine particles to uniformly exist on the surface of each core particle, it is preferred that aggregates of core particles be previously deagglomerated by using a pulverizer. As apparatuses used for the mixing and stirring, there may be exemplified an edge runner, a Henschel mixer or the like.

The mixing and stirring conditions such as amounts of respective particles added, linear load, stirring velocity, mixing and stirring time, etc., may be appropriately selected such that the fine particles are allowed to adhere or exist on the surface of each core particle as uniformly as possible. The treating (mixing and stirring) time is preferably not less than 20 minutes.

The coating treatment of the core particles on the surfaces of which the fine particles are adhered or exist, or on the surfaces of which the fine particles are adhered or exist and the exposed surface of the core particle, with the methyl hydrogen polysiloxane, may be conducted by mechanically mixing and stirring the core particles on the surfaces of which the fine particles are adhered or exist, together with the methyl hydrogen polysiloxane, or by mechanically mixing and stirring the core particles on the surfaces of which the fine particles are adhered or exist, together with the methyl hydrogen polysiloxane while spraying the methyl hydrogen polysiloxane over the core particles. A substantially whole amount of the methyl hydrogen polysiloxane added can be used to coat the surfaces of the core particles on which the fine particles are adhered or exist, or the surfaces of which the fine particles are adhered or exist (are deposited) and the exposed surface of the core particle.

The mixing and stirring conditions for the coating treatment, such as amounts of respective components added, linear load, stirring velocity, mixing and stirring time, etc., may be appropriately selected such that the core particle on the surfaces of which the fine particles are adhered or exist, are coated with the methyl hydrogen polysiloxane as uniformly as possible. The treating (mixing and stirring) time is preferably not less than 20 minutes.

After completion of coating the core particles on the surfaces of which the fine particles are adhered or exist, or on the surfaces of which the fine particles are adhered or exist (are deposited) and the exposed surface of the core particle, with methyl hydrogen polysiloxane, the resultant particles are dried, thereby obtaining black non-magnetic composite particles.

In advance of allowing the fine particles to adhere or exist on the surfaces of the core particles, the core particles may be optionally coated with at least one compound selected from the group consisting of hydroxides of aluminum, oxides of aluminum, hydroxides of silicon and oxides of silicon.

The coating of the hydroxides and/or oxides of aluminum and/or silicon may be conducted by adding an aluminum compound, a silicon compound or both the compounds to a water suspension in which the core particles are dispersed, followed by mixing and stirring, and after further mixing and stirring, adjusting the pH value of the suspension, if required, thereby coating at least a part of the surfaces of the core particles with at least one compound selected from the group consisting of hydroxides of aluminum, oxides of aluminum, hydroxides of silicon and oxides of silicon. The thus obtained particles coated with the hydroxides and/or oxides of aluminum and/or silicon are then filtered out, washed with water, dried and pulverized. Further, the particles coated with the hydroxides and/or oxides of aluminum and/or silicon may be subjected to post-treatments such as deaeration treatment and compaction treatment, if required.

As the aluminum compounds, there may be exemplified aluminum salts such as aluminum acetate, aluminum sulfate, aluminum chloride or aluminum nitrate, alkali aluminates such as sodium aluminate, alumina sols or the like.

The amount of the aluminum compound added is 0.01 to 50% by weight (calculated as Al) based on the weight of the core particles. When the amount of the aluminum compound added is less than 0.01% by weight, it may be difficult to sufficiently coat the surfaces of the core particles with hydroxides and/or oxides of aluminum, thereby failing to achieve the improvement of the the flowability of the obtained black non-magnetic composite particles. On the other hand, when the amount of the aluminum compound added is more than 50% by weight, the coating effect is saturated and, therefore, it is meaningless to add such an excess amount of the aluminum compound.

As the silicon compounds, there may be exemplified #3 water glass, sodium orthosilicate, sodium metasilicate or the like.

The amount of the silicon compound added is 0.01 to 50% by weight (calculated as $SiO_2$) based on the weight of the core particles. When the amount of the silicon compound added is less than 0.01% by weight, it may be difficult to sufficiently coat the surfaces of the core particles with hydroxides and/or oxides of silicon, thereby failing to achieve the improvement of the flowability of the obtained black non-magnetic composite particles. On the other hand, when the amount of the silicon compound added is more than 50% by weight, the coating effect is saturated and, therefore, it is meaningless to add such an excess amount of the silicon compound.

In the case where both the aluminum and silicon compounds are used in combination for the coating, the total amount of the aluminum and silicon compounds added is preferably 0.01 to 50% by weight (calculated as a sum of Al and $SiO_2$) based on the weight of the core particles.

Next, the process for producing the black toner according to the present invention is described.

The black toner according to the present invention which is composed of the composite particles (1) wherein the black non-magnetic composite particles exist therein and wherein a part of the black non-magnetic composite particles contained therein is exposed to the surface thereof, may be produced by a known method of first mixing and kneading a predetermined amount of a binder resin with a predetermined amount of the black non-magnetic composite particles, and then pulverizing the resultant mixture. More specifically, the black non-magnetic composite particles and the binder resin are intimately mixed together with, if necessary, a mold release agent, a colorant, a charge-controlling agent or other additives by using a mixer. The obtained mixture is then melted and kneaded by a heating kneader so as to render the respective components compatible with each other, thereby dispersing the black non-magnetic composite particles, etc., therein. Successively, the molten mixture is cooled and solidified to obtain a resin mixture. The obtained resin mixture is then pulverized and classified, thereby producing a black toner having an aimed particle size.

As the mixers, there may be used a Henschel mixer, a ball mill or the like. As the heating kneaders, there may be used a roll mill, a kneader, a twin-screw extruder or the like. The pulverization of the mixed product may be conducted by using pulverizers such as a cutter mill, a jet mill or the like. The classification of the pulverized particles may be conducted by known methods such as air classification, etc., as described in Japanese Patent No. 2683142 or the like.

As the other method of producing the black toner, there may be exemplified a suspension polymerization method or an emulsion polymerization method. In the suspension polymerization method, polymerizable monomers and the black non-magnetic composite particles are intimately mixed together with, if necessary, a colorant, a polymerization initiator, a cross-linking agent, a charge-controlling agent or the other additives and then the obtained mixture is dissolved and dispersed together so as to obtain a monomer composition. The obtained monomer composition is added to a water phase containing a suspension stabilizer while stirring, thereby granulating and polymerizing the composition to form black toner particles having an aimed particle size.

In the emulsion polymerization method, the monomers and the black non-magnetic composite particles are dispersed in water together with, if necessary, a colorant, a polymerization initiator or the like and then the obtained dispersion is polymerized while adding an emulsifier thereto, thereby producing black toner particles having an aimed particle size.

The black toner according to the present invention which are composed of the composite particles (2) on the surfaces of which the black non-magnetic composite particles are adhered or exist, may be produced by a known method of mixing a predetermined amount of the composite particles with a predetermined amount of the black non-magnetic composite particles. More specifically, the black non-magnetic composite particles and the composite particles are intimately mixed together by using a mixer, thereby producing an aimed black toner. As the mixers, there may be used a Henschel mixer, a ball mill or the like.

The black toner according to the present invention which are composed of the composite particles (3) wherein the black non-magnetic composite particles exist therein and a part of the black non-magnetic composite particles contained therein is exposed to the surface thereof, and wherein the black non-magnetic composite particles are adhered or exist on the surface thereof, may be produced by the above-mentioned processes of the composite particles (1) and (2).

The important point of the present invention liets in such a fact that the black non-magnetic composite particles which are composed of black hematite particles or black iron oxide hydroxide particles as the core particles and have an average particle size of 0.08 to 1.0 $\mu$m, and in which the fine particles exist between either the surface of each black hematite particle or black iron oxide hydroxide particle, or the surface of a coat which may be coated onto the surface of each core particle and comprises at least one compound selected from the group consisting of hydroxides of aluminum, oxides of aluminum, hydroxides of silicon and oxides of silicon, and the methyl hydrogen polysiloxane coating layer, can show not only an excellent flowability but also a high volume resistivity capable of preventing the deterioration in charge amount of the black toner even when a large amount of the black non-magnetic composite particles are contained in the black toner.

The reason why the black non-magnetic composite particles according to the present invention can show an excellent flowability, is considered as follows. That is, since a large number of the fine particles are uniformly adhered onto the surfaces of the black hematite particles or black iron oxide hydroxide particles, many fine irregularities can be formed on the surface of the core particle.

The reason why the black non-magnetic composite particles according to the present invention can exhibit a high volume resistivity, is considered as follows. That is, due to the fact that black non-magnetic composite particles having a high volume resistivity cannot be obtained in any of the cases where only the fine particles exist on the surface of each core particle, where only the methyl hydrogen polysiloxane coating layer exist on the surface of each core particle, where the fine particles are adhered or exist on the surface of the methyl hydrogen polysiloxane coating layer formed on the surface of each core particle, and where a specific amount of the fine particles exist between the surface of each core particle and the methyl hydrogen polysiloxane coating layer but the amount of methyl hydrogen polysiloxane applied is insufficient so that the fine particles are not completely covered with the methyl hydrogen polysiloxane coating layer, it is considered that there exists a synergistic effect based on the specific amount of methyl hydrogen polysiloxane and the fine particles coated with the methyl hydrogen polysiloxane.

The reason why the reduction the charge amount of black toner according to the present invention can be inhibited, even if a large amount of the black non-magnetic composite particles according to the present invention is contained in the black toner, is considered as follows. That is, the black non-magnetic composite particles according to the present invention have a high volume resistivity.

Incidentally, in the black non-magnetic composite particles according to the present invention, since the fine particles and the methyl hydrogen polysiloxane are transparent, the blackness of the core particles are not adversely affected by these components. As a result, the obtained black non-magnetic composite particles can show substantially the same blackness as that of the core particles.

Since the black non-magnetic composite particles according to the present invention exhibit not only an excellent flowability but also a high volume resistivity, the composite particles are suitable as black non-magnetic composite particles for black toner capable of attaining a high image quality and a high copying speed.

In addition, since the black non-magnetic composite particles according to the present invention, are excellent in flowability, the particles can show excellent handling property and workability and, therefore, are preferable from an industrial viewpoint.

Further, the black toner produced from the above black non-magnetic composite particles which show an excellent flowability and a high volume resistivity, can also show an excellent flowability and a high volume resistivity. Accordingly, the black toner is suitable as black toner capable of attaining a high image quality and a high copying speed.

EXAMPLES

The present invention is described in more detail by Examples and Comparative Examples, but the Examples are only illustrative and, therefore, not intended to limit the scope of the present invention.

Various properties were measured by the following methods.

(1) The average particle size, the average major axis diameter and average minor axis diameter of black hematite particles and black iron oxide hydroxide particles as core particles, and black non-magnetic composite particles were respectively expressed by the average of values (measured in a predetermined direction) of about 350 particles which were sampled from a micrograph obtained by magnifying an original electron micrograph (×20,000) by four times in each of the longitudinal and transverse directions.

(2) The sphericity is expressed by a ratio of average maximum diameter to average minimum diameter of the isotropic core particles, and the aspect ratio is expressed by a ratio of average major axis diameter to average minor axis diameter of the anisotropic core particles.

(3) The geometrical standard deviation of particle sizes was expressed by values obtained by the following method. That is, the particle sizes (major axis diameters) were measured from the above magnified electron micrograph. The actual particle sizes (major axis diameters) and the number of the particles were calculated from the measured values. On a logarithmic normal probability paper, the particle sizes (major axis diameters) were plotted at regular intervals on the abscissa-axis and the accumulative number (under integration sieve) of particles belonging to each interval of the particle sizes (major axis diameters) were plotted by percentage on the ordinate-axis by a statistical technique.

The particle sizes (major axis diameters) corresponding to the number of particles of 50% and 84.13% , respectively, were read from the graph, and the geometrical standard deviation was calculated from the following formula:

Geometrical standard deviation={particle size (major axis diameters) corresponding to 84.13% under integration sieve)}/{particle size (major axis diameters) (geometrical average diameter) corresponding to 50% under integration sieve}

The closer to 1 the geometrical standard deviation value, the more excellent the particle size distribution.

(4) The specific surface area was expressed by the value measured by a BET method.

(5) The amounts of Al, Si and Mn existing the inside or onto the surface of each black hematite particle or black iron oxide hydroxide particle as a core particle, the amounts of Si, Al, Ti, Zr and Ce existing on the surface of each black hematite particle or black iron oxide hydroxide particle as a core particle, and the amount of Si contained in methyl hydrogen polysiloxane coated onto the surface of each black hematite particle or black iron oxide hydroxide particle as a core particle, were measured by a fluorescent X-ray spectroscopy device "3063M Model" (manufactured by Rigaku Denki Kogyo Co., Ltd.) according to JIS K0119 "General rule of fluorescent X-ray analysis".

Incidentally, the respective amounts of Si contained in oxides of silicon, hydroxides of silicon, silicon oxide fine particles, silicon oxide hydroxide fine particles and methyl hydrogen polysiloxane coated or existing on the surface of each black hematite particle or black iron oxide hydroxide particle as a core particle, are each expressed by a value obtained by subtracting an amount of Si measured before each treatment from the amount of Si measured after the treatment. Further, the respective amounts of Al contained in hydroxides of aluminum, oxides of aluminum, aluminum oxide fine particles and aluminum oxide hydroxide fine particles coated or existing on the surface of each black hematite particle or black iron oxide hydroxide particle as a core particle, are also expressed by values obtained in the same manner as above.

(6) The flowability of black hematite particles and black iron oxide hydroxide particles as core particles, black non-magnetic composite particles and black toner was expressed by a fluidity index which was a sum of indices obtained by converting on the basis of the same reference measured values of an angle of repose, a degree of compaction (%), an angle of spatula and a degree of agglomeration as particle characteristics which were measured by a powder tester (tradename, produced by Hosokawa Micron Co., Ltd.). The closer to 100 the fluidity index, the more excellent the flowability of the particles.

(7) The blackness of black hematite particles and black iron oxide hydroxide particles as core particles, black non-magnetic composite particles and black toner was measured by the following method. That is, 0.5 g of sample particles and 1.5 cc of castor oil were intimately kneaded together by a Hoover's muller to form a paste. 4.5 g of clear lacquer was added to the obtained paste and was intimately kneaded to form a paint. The obtained paint was applied on a cast-coated paper by using a 6-mil applicator to produce a coating film piece (having a film thickness of about 30 μm). The thus obtained coating film piece was measured according to JIS Z 8729 by a multi-light source spectrographic calorimeter MSC-IS-2D (manufactured by Suga Testing Machines Manufacturing Co., Ltd.) to determine an L* value of calorimetric indices thereof. The blackness was expressed by the L* value measured.

Here, the L* value represents a lightness, and the smaller the L* value, the more excellent the blackness.

(8) The volume resistivity of the black hematite particles or black iron oxide hydroxide particles as core particles, the black non-magnetic composite particles and the black toner was measured by the following method.

That is, first, 0.5 g of a sample particles or toner to be measured was weighted, and press-molded at 140 Kg/cm$^2$ using a KBr tablet machine (manufactured by Simazu Seisakusho Co., Ltd.), thereby forming a cylindrical test piece.

Next, the thus obtained cylindrical test piece was exposed to an atmosphere maintained at a temperature of 25° C. and a relative humidity of 60% for 12 hours. Thereafter, the cylindrical test piece was set between stainless steel electrodes, and a voltage of 15V was applied between the electrodes using a Wheatstone bridge (TYPE2768, manufactured by Yokogawa-Hokushin Denki Co., Ltd.) to measure a resistance value R (Ω).

The cylindrical test piece was measured with respect to an upper surface area A (cm$^2$) and a thickness $t_0$ (cm) thereof. The measured values were inserted into the following formula, thereby obtaining a volume resistivity X (Ω·cm).

$$X(\Omega\cdot cm)=R\times(A/t_0)$$

(9) The average particle size of the black toner was measured by a laser diffraction-type particle size distribution-measuring apparatus (Model HELOSLA/KA, manufactured by Sympatec Corp.).

(10) The dispersibility in a binder resin of the black non-magnetic composite particles was evaluated by counting the number of undispersed agglomerated particles on a micrograph (×200 times) obtained by photographing a sectional area of the obtained black toner particle using an optical microscope (BH-2, manufactured by Olympus Kogaku Kogyo Co., Ltd.), and classifying the results into the following five ranks. The 5th rank represents the most excellent dispersing condition.

Rank 1: not less than 50 undispersed agglomerated particles per 0.25 mm$^2$ were recognized;

Rank 2: 10 to 49 undispersed agglomerated particles per 0.25 mm$^2$ were recognized;

Rank 3: 5 to 9 undispersed agglomerated particles per 0.25 mm$^2$ were recognized;

Rank 4: 1 to 4 undispersed agglomerated particles per 0.25 mm$^2$ were recognized;

Rank 5: No undispersed agglomerated particles were recognized.

Example 1

<Production of black non-magnetic composite particles>

20 kg of granular Mn-containing hematite particles shown in the electron micrograph (×20,000) of FIG. 1 (average particle size: 0.30 μm; sphericity: 1.3:1; geometrical standard deviation value: 1.46; BET specific surface area value: 3.6 m$^2$/g; Mn content: 13.3% by weight (calculated as Mn) based on the weight of the particle; fluidity index: 36; blackness (L* value): 22.6; volume resistivity of 3.8×10$^7$ Ω·cm) which were produced by the method described in Japanese Patent Application Laid-open (KOKAI) No. 4-144924, were deagglomerated in 150 liters of pure water using a stirrer, and further passed through a "TK pipeline homomixer" (tradename, manufactured by Tokushu Kika Kogyo Co., Ltd.) three times, thereby obtaining a slurry containing the granular Mn-containing hematite particles.

Successively, the obtained slurry containing the granular Mn-containing hematite particles was passed through a transverse-type sand grinder (tradename "MIGHTY MILL MHG-1.5L", manufactured by Inoue Seisakusho Co., Ltd.) five times at an axis-rotating speed of 2,000 rpm, thereby obtaining a slurry in which the granular Mn-containing hematite particles were dispersed.

The particles in the obtained slurry which remained on a sieve of 325 meshes (mesh size: 44 μm) was 0%. The slurry was filtered and washed with water, thereby obtaining a filter cake containing the granular Mn-containing hematite particles. After the obtained filter cake containing the granular Mn-containing hematite particles was dried at 120° C., 11.0 kg of the dried particles were then charged into an edge runner "MPUV-2 Model" (tradename, manufactured by Matsumoto Chuzo Tekkosho Co., Ltd.), and mixed and stirred at 30 kg/cm for 30 minutes, thereby lightly deagglomerating the particles.

Next, 2,750 g of a colloidal silica solution Snowtex-XS (tradename, produced by Nissan Kagaku Kogyo, Co., Ltd.) containing silicon oxide fine particles having an average particle size of 0.005 μm ($SiO_2$ content: 20% by weight), was added to the deagglomerated granular Mn-containing hematite particles under the operation of the edge runner. The granular Mn-containing hematite particles were continuously mixed and stirred at a linear load of 60 kg/cm for 60 minutes, thereby adhering the silicon oxide fine particles onto the surface of each granular Mn-containing hematite particle. The obtained black particles were subjected to fluorescent X-ray analysis, so that it was confirmed that the amount of the silicon oxide fine particles adhered or existing was 5.0% by weight (calculated as $SiO_2$) based on the weight of the granular Mn-containing hematite particles.

Figure 2:
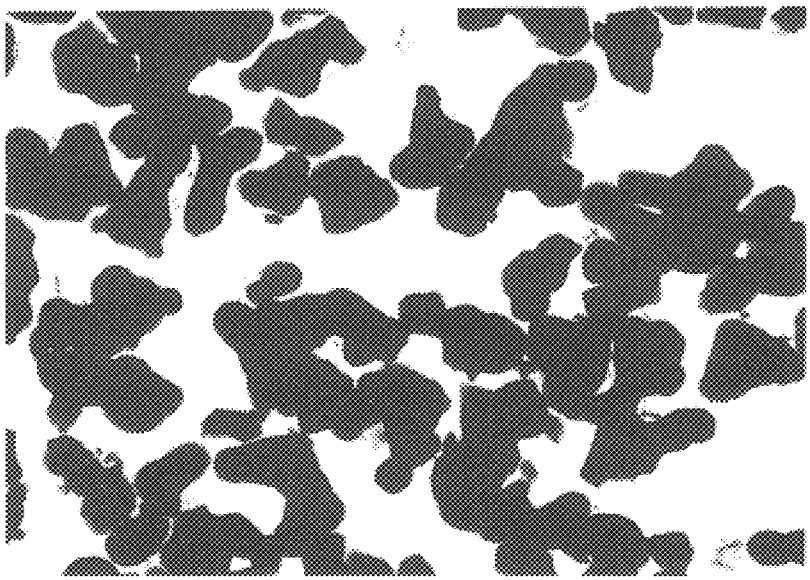
FIG. 2 is an electron micrograph (×20,000) showing a particle structure of granular Mn-containing hematite particles obtained in Example 1 on the surfaces of which silicon oxide fine particles are adhered or exist.

In addition, as shown in the electron micrograph (×20,000) of FIG. 2, since no independent silicon oxide fine particles were observed, it was confirmed that a substantially whole amount of the silicon oxide fine particles added existed or were adhered onto the surfaces of the granular Mn-containing hematite particles.

Next, 550 g of a methyl hydrogen polysiloxane TSF484 (tradename, produced by Toshiba Silicone Co., Ltd.) was added to the obtained particles for 10 minutes while operating the edge runner. Further, the mixture were continuously mixed and stirred at a linear load of 60 kg/cm for 60 minutes to coat the granular Mn-containing hematite particles on the surfaces of which the silicon oxide fine particles existed or were adhered, with methyl hydrogen polysiloxane, thereby obtaining black non-magnetic composite particles in which the silicon oxide fine particles existed between the surface of each granular Mn-containing hematite particle and the methyl hydrogen polysiloxane coating layer.

The obtained black non-magnetic composite particles were dried at 80° C. for 180 minutes by using a drier to evaporate water, etc. which remained on the surfaces thereof.

Figure 3:
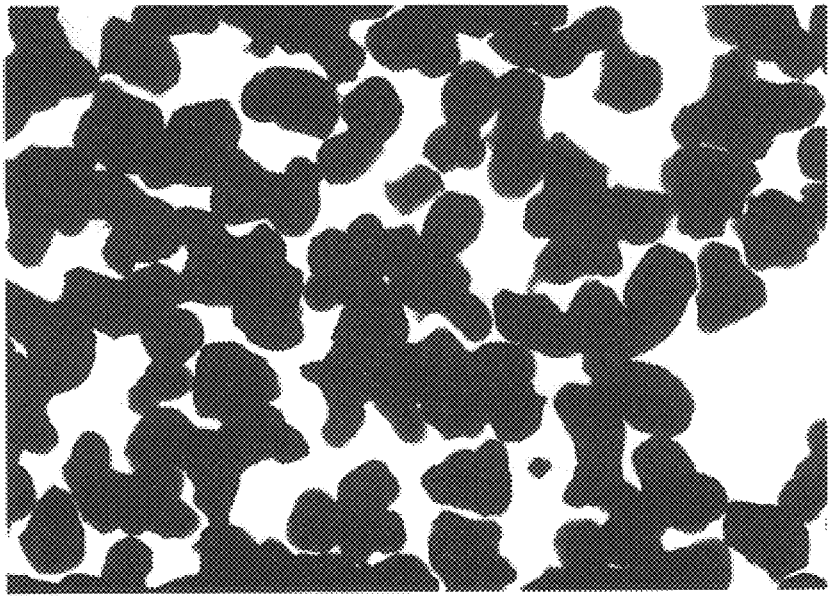
FIG. 3 is an electron micrograph (×20,000) showing a particle structure of black non-magnetic composite particles obtained in Example 1.

As shown in the electron micrograph (×20,000) of FIG. 3, the resultant black non-magnetic composite particles had an average particle size of 0.31 μm. In addition, as shown in FIG. 3, since no independent silicon oxide fine particles were observed, it was confirmed that a substantially whole amount of the silicon oxide fine particles added were adhered or existed on the surface of each granular Mn-containing hematite particle. The obtained black non-magnetic composite particles exhibited a sphericity of 1.3:1, a geometrical standard deviation value of 1.46, a BET specific surface area value of 14.6 $m^2/g$, a fluidity index of 51, a blackness (L* value) of 22.8 and a volume resistivity of $3.6\times10^{10}$ Ω·cm. As a result of the fluorescent X-ray analysis, it was confirmed that the amount of methyl hydrogen polysiloxane applied was 4.66% by weight (calculated as $SiO_2$) based on the weight of the black non-magnetic composite particles.

Figure 4:
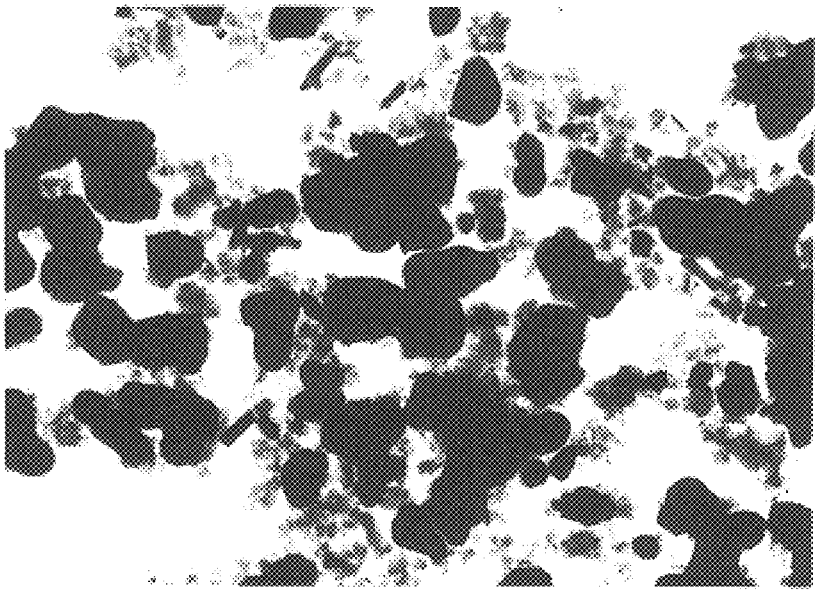
FIG. 4 is an electron micrograph (×20,000) showing a particle structure of mixed particles composed of the granular Mn-containing hematite particles and the silicon oxide fine particles.
Figure 5:
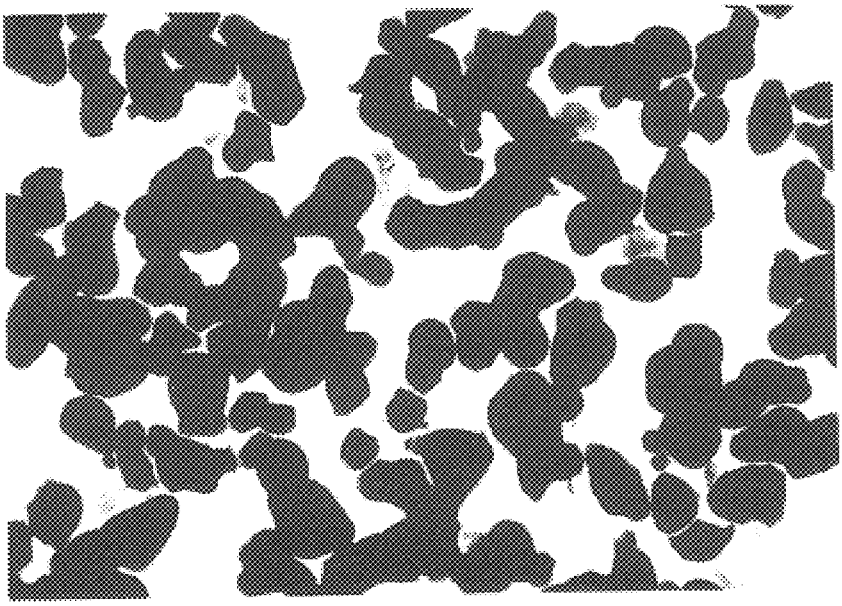
FIG. 5 is an electron micrograph (×20,000) showing a particle structure of black non-magnetic composite particles obtained in Example 9.
Figure 6:
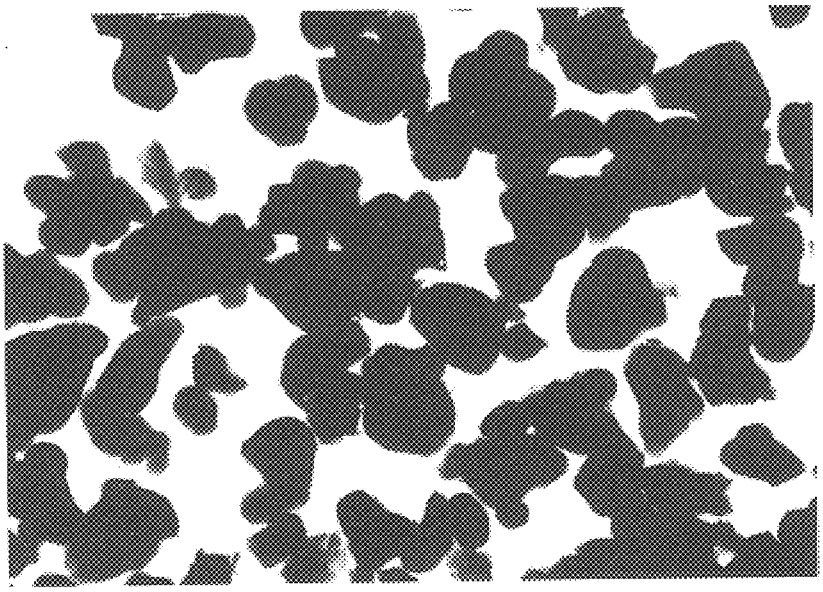
FIG. 6 is an electron micrograph (×20,000) showing a particle structure of black non-magnetic composite particles obtained in Example 10.
Figure 7:
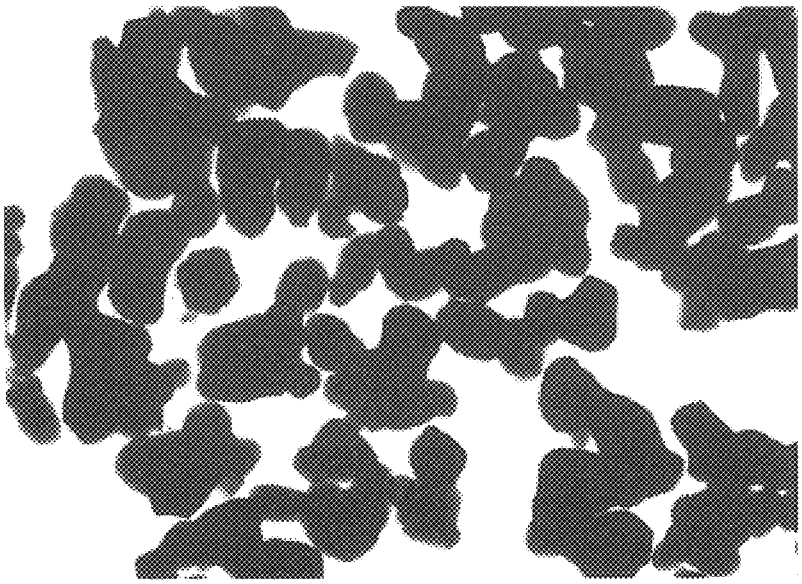
FIG. 7 is an electron micrograph (×20,000) showing a particle structure of black non-magnetic composite particles obtained in Example 11.
Figure 8:
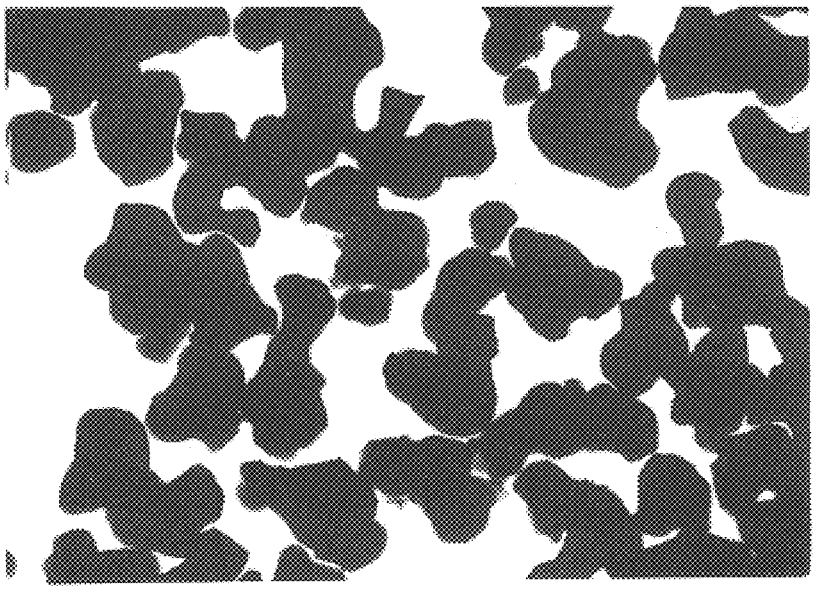
FIG. 8 is an electron micrograph (×20,000) showing a particle structure of black non-magnetic composite particles obtained in Example 12.

For comparative purpose, the granular Mn-containing hematite particles and the colloidal silica solution containing the silicon oxide fine particles were mixed and stirred for 30 minutes using a powder mixer, thereby obtaining black particles. FIG. 4 shows an electron micrograph (×20,000) of the obtained black particles. As shown in FIG. 4, it was confirmed that the silicon oxide fine particles did not exist on the surfaces of the granular Mn-containing hematite particles, and the obtained black particles were mixed particles composed of the granular Mn-containing hematite particles and the silicon oxide fine particles.

Example 2

<Production of black toner containing black non-magnetic composite particles>

<Production of black toner (I)>

150 g of the black non-magnetic composite particles obtained in Example 1, 756 g of styrene-butyl acrylate-methyl methacrylate copolymer resin (molecular weight= 150,000, styrene/butyl acrylate/methyl methacrylate=87.0/12.5/0.5), 85 g of polypropylene wax (molecular weight: 3,000) and 15 g of a charge-controlling agent were charged into a Henschel mixer, and mixed and stirred therein at 60° C. for 15 minutes. The obtained mixed particles were melt-kneaded at 140° C. using a continuous-type twin-screw kneader (T-1), and the obtained kneaded material was cooled, coarsely pulverized and finely pulverized in air. The obtained particles were subjected to classification, thereby producing a black toner (I).

The obtained black toner (I) had an average particle size of 10.1 μm, a dispersibility of 5th rank, a fluidity index of 78, a blackness (L* value) of 23.1, a volume resistivity of $6.8\times10^{14}$ Ω·cm.

<Production of black toner (II)>

150 g of spherical Mn-containing hematite particles (sphericity: 1.3:1, average particle size: 0.30 μm, geometrical standard deviation value: 1.46, BET specific surface area value: 3.6 $m^2/g$, manganese content: 13.3% by weight, fluidity index: 36, blackness (L* value): 22.6, volume resistivity: $3.8\times10^7$ Ω·cm), 765 g of styrene-butyl acrylate-methyl methacrylate copolymer resin (molecular weight= 130,000, styrene/butyl acrylate/methyl methacrylate=82.0/16.5/1.5), 85 g of polypropylene wax (molecular weight: 3,000) and 15 g of a charge-controlling agent were charged into a Henschel mixer, and mixed and stirred therein at 60° C. for 15 minutes, thereby obtaining a mixture. The obtained mixture was melt-kneaded at 140° C. using a continuous-type twin-screw kneader (T-1), and the obtained kneaded material was cooled in air, coarsely pulverized and finely pulverized. Thereafter, the obtained particles were subjected to classification, thereby producing composite particles.

101.5 g of the obtained composite particles and 1.0 g of the above black non-magnetic composite particles obtained in Example 1, were charged into a bench-type mini-pulverizer D150A (manufactured by Taninaka Co., Ltd.), and mixed and dispersed together for one minute to adhere the black non-magnetic composite particles on the surfaces of the composite particles, thereby producing a black toner (II).

The obtained black toner (II) had an average particle size of 10.0 μm, a fluidity index of 76, a blackness (L* value) of 22.9 and a volume resistivity of $5.6\times10^{14}$ Ω·cm.

<Production of black toner (III)>

101.5 g of the black toner (I) and 1.0 g of the above black non-magnetic composite particles obtained in Example 1 were charged into a bench-type mini-pulverizer D150A (manufactured by Taninaka Co., Ltd.), and mixed and dispersed together for one minute to adhere the black non-magnetic composite particles on the surface of the black toner (I), thereby producing a black toner (III).

The obtained black toner (III) had an average particle size of 10.1 μm, a fluidity index of 89, a blackness (L* value) of 21.8 and a volume resistivity of $9.8\times10^{14}$ Ω·cm.

Core Particles 1 to 4:

Various core particles were prepared by known methods. The same procedure as defined in Example 1 was conducted by using the thus prepared particles, thereby obtaining deagglomerated core particles as core particles.

Various properties of the core particles are shown in Table 1.

Core Particles 5:

The same procedure as defined in Example 1 was conducted by using 20 kg of the deagglomerated granular Mn-containing hematite particles (core particles 1) and 150 liters of water, thereby obtaining a slurry containing the granular Mn-containing hematite particles. The pH value of the obtained re-dispersed slurry containing the granular Mn-containing hematite particles was adjusted to 10.5 adding an aqueous sodium hydroxide solution, and then the concentration of the slurry was adjusted to 98 g/liter by adding water thereto. After 150 liters of the slurry was heated to 60° C., 5444 ml of a 1.0 mol/liter sodium alminate solution (equivalent to 1.0% by weight (calculated as Al) based on the weight of the granular Mn-containing hematite particles) was added to the slurry. After allowing the slurry to stand for 30 minutes, the pH value of the slurry was adjusted to 7.5 by adding an aqueous acetic acid solution. After allowing the slurry to stand for 30 minutes, the slurry was subjected to filtration, washing with water, drying and pulverization, thereby obtaining the granular Mn-containing hematite particles coated with hydroxides of aluminum.

As a result of fluorescent X-ray analysis, it was confirmed that the content of hydroxides of aluminum was 0.98% by weight (calculated as Al) based on the weight of the granular Mn-containing hematite particles.

The obtained granular Mn-containing hematite particles whose surfaces were coated with hydroxides of aluminum, had an average particle size of 0.32 μm, a geometrical standard deviation value of 1.47, a BET specific surface area value of 4.6 $m^2/g$, a fluidity index of 38, a blackness (L* value) of 22.5 and a volume resistivity of $5.8\times10^7$ Ω·cm. The content of Mn contained in the obtained granular Mn-containing hematite particles was 12.9% by weight (calculated as Mn) based on the weight of the granular Mn-containing hematite particles.

Core Particles 6 to 8:

The same procedure as defined in the production of the core particles 5 above, was conducted except that kind of core particles, and kind and amount of additives used in the surface treatment were varied, thereby obtaining surface-treated black hematite particles or black iron oxide hydroxide particles.

Main production conditions are shown in Table 2, and various properties of the obtained surface-treated black hematite particles or black iron oxide hydroxide particles are shown in Table 3.

Examples 3 to 16 and Comparative Examples 1 to 5

<Production of black non-magnetic composite particles>

The same procedure as defined in Example 1 was conducted except that kind of core particles, addition or non-addition of a colloidal solution containing fine particles in the fine particle-adhesion step, kind and amount of the colloidal solution added, treating conditions of edge runner in the fine particle-adhesion step, kind and amount of methyl hydrogen polysiloxane added in the step for coating with methyl hydrogen polysiloxane and treating conditions of edge runner in the coating step, were varied, thereby obtaining black non-magnetic composite particles. The black non-magnetic composite particles obtained in Examples 3 to 16 were observed by an electron microscope. As a result, almost no independent fine particles were recognized. Therefore, it was confirmed that a substantially whole amount of the fine particles existed or were adhered on the surfaces of the core particles.

Electron micrographs of the black non-magnetic composite particles obtained in Examples 11 to 14 are shown in FIGS. 5 to 8, respectively.

Incidentally, in Comparative Example 5, the core particles were coated with methyl hydrogen polysiloxane, and then silicon oxide fine particles were caused to exist on the surface of the thus coated core particles.

Kinds and various properties of the fine particles are shown in Table 4, main treating conditions of the coating step with methyl hydrogen polysiloxane are shown in Table 5, and various properties of the obtained black non-magnetic composite particles are shown in Table 6.

Examples 17 to 30 and Comparative Examples 6 to 14

<Production of black toners>

The same procedure as defined in the black toner (I) of Example 2, was conducted except that the black non-magnetic composite particles obtained in Examples 3 to 16, the core particles 1 to 4 and the black non-magnetic composite particles obtained in Comparative Examples 1 to 5 were used, and the mixing ratio between the black non-magnetic composite particles and the binder resin was varied, thereby obtaining black toners.

Main production conditions and various properties of the obtained black toners are shown in Tables 7 and 8.

Examples 31 to 44

The same procedure as defined in the black toner (II) of Example 2, was conducted except that kind of the black particles used for the production of composite particles, the mixing ratio between the black particles and the binder resin, and kind and amount of the black non-magnetic composite particles adhered onto the composite particles, were varied, thereby obtaining black toners.

Main production conditions and various properties of the obtained black toners are shown in Table 9.

Examples 45 to 58

The same procedure as defined in the black toner (III) of Example 2, was conducted except that kind of the composite particles using the black non-magnetic composite particles according to the present invention, and kind and amount of the black non-magnetic composite particles adhered onto the composite particles, were varied, thereby obtaining black toners.

Main production conditions and various properties of the obtained black toners are shown in Table 10.

Examples 59 to 62

The same procedure as defined in the black toner (I) of Example 2, was conducted except that the black non-magnetic composite particles obtained in Examples 3 to 6 and the core particles 1 to 4 were used as black non-magnetic particles contained in the composite particles and exposed to the surfaces thereof, and the mixing ratios between the black non-magnetic composite particles and the core particles and between the black non-magnetic particles and the binder resin, were varied, thereby obtaining black toners.

Main production conditions and various properties of the obtained black toners are shown in Table 11.

Examples 63 to 72

The same procedure as defined in the black toner (III) of Example 2, was conducted except that the black non-magnetic composite particles obtained in Examples 7 to 16 and the core particles 1 to 8 were used as black non-magnetic particles contained in composite particles and exposed to the surfaces thereof, and the amounts of these particles mixed were varied, thereby obtaining black toners.

Main production conditions and various properties of the obtained black toners are shown in Table 12.

TABLE 1

| | Properties of core particles | | | | | | | | | |
|---|---|---|---|---|---|---|---|---|---|---|
| Core particles | Kind | Particle shape | Average particle size (μm) | Aspect ratio (sphericity) (–) | Geometrical standard deviation (–) | BET specific surface area ($m^2/g$) | Mn content (wt. %) | Fluidity index (–) | Blackness (L* value) (–) | Volume resistivity (Ω · cm) |
| Core particles 1 | Mn-containing hematite particles | Granular | 0.32 | 1.3:1 | 1.49 | 3.1 | 13.1 | 31 | 22.4 | $4.6 \times 10^7$ |
| Core particles 2 | Mn-containing hematite particles | Granular | 0.18 | 1.3:1 | 1.41 | 7.8 | 15.6 | 34 | 24.4 | $4.4 \times 10^7$ |

TABLE 1-continued

| Core particles | Properties of core particles | | | | | | | | | |
|---|---|---|---|---|---|---|---|---|---|---|
| | Kind | Particle shape | Average particle size (μm) | Aspect ratio (sphericity) (–) | Geometrical standard deviation (–) | BET specific surface area ($m^2/g$) | Mn content (wt. %) | Fluidity index (–) | Blackness (L* value) (–) | Volume resistivity (Ω · cm) |
| Core particles 3 | Mn-containing goethite particles | Acicular | 0.28 | 7.3:1 | 1.38 | 84.3 | 17.6 | 38 | 26.5 | $9.6 \times 10^6$ |
| Core particles 4 | Mn-containing hematite particles | Spindle-shaped | 0.20 | 6.7:1 | 1.41 | 45.8 | 13.6 | 36 | 24.9 | $3.2 \times 10^7$ |

TABLE 2

| Core particles | Kind of core particles | Surface-treating process | | | | | |
|---|---|---|---|---|---|---|---|
| | | Additives | | | Coating material | | |
| | | Kind | Calculated as | Amount (wt. %) | Kinds | Calculated as | Amount (wt. %) |
| Core particles 5 | Core particles 1 | Sodium aluminate | Al | 1.0 | Hydroxide of aluminum | Al | 0.98 |
| Core particles 6 | Core particles 2 | Water glass | $SiO_2$ | 0.2 | Oxide of silicon | $SiO_2$ | 0.18 |
| Core particles 7 | Core particles 3 | Aluminum sulfate | Al | 1.0 | Hydroxide of aluminum | Al | 0.98 |
| | | Water glass #3 | $SiO_2$ | 0.4 | Oxide of silicon | $SiO_2$ | 0.38 |
| Core particles 8 | Core particles 4 | Sodium aluminate | Al | 1.0 | Hydroxide of aluminum | Al | 0.98 |

35

TABLE 3

| Core particles | Properties of surface-treated core particles | | | | | | | |
|---|---|---|---|---|---|---|---|---|
| | Average particle size (μm) | Aspect ratio (sphericity) (–) | Geometrical standard deviation (–) | BET specific surface area ($m^2/g$) | Mn content (wt. %) | Fluidity index (–) | Blackness (L* value) (–) | Volume resistivity (Ω · cm) |
| Core particles 5 | 0.32 | 1.3:1 | 1.47 | 4.6 | 12.9 | 30 | 22.7 | $4.8 \times 10^7$ |
| Core particles 6 | 0.18 | 1.3:1 | 1.40 | 7.5 | 15.6 | 35 | 25.1 | $4.6 \times 10^7$ |
| Core particles 7 | 0.28 | 7.3:1 | 1.38 | 82.1 | 17.4 | 38 | 26.8 | $1.3 \times 10^7$ |
| Core particles 8 | 0.20 | 6.7:1 | 1.41 | 45.8 | 13.4 | 37 | 24.8 | $4.5 \times 10^7$ |

TABLE 4

| Fine particles | Kind of fine particles | Properties of fine particles | | |
|---|---|---|---|---|
| | | Particle shape | Average particle size (μm) | Geometrical standard deviation (–) |
| Silicon oxide | Snowtex-XS ($SiO_2$ content: 20%, | Granular | 0.005 | 1.46 |

TABLE 4-continued

| Fine particles | Kind of fine particles | Properties of fine particles: Particle shape | Average particle size (μm) | Geometrical standard deviation (–) |
|---|---|---|---|---|
| fine particles A | produced by Nissan Kagaku Kogyo Co., Ltd.) | | | |
| Silicon oxide fine particles B | Snowtex-SS ($SiO_2$ content: 15%, produced by Nissan Kagaku Kogyo Co., Ltd.) | Granular | 0.005 | 1.45 |
| Silicon oxide fine particles C | Snowtex-UP ($SiO_2$ content: 20%, produced by Nissan Kagaku Kogyo Co., Ltd.) | Elongated | 0.015 | 2.56 |
| Hydrated alumina fine particles D | AS-520 ($Al_2O_3$ content: 20%, produced by Nissan Kagaku Kogyo Co., Ltd.) | Granular | 0.015 | 2.14 |
| Titania fine particles E | STS-01 ($TiO_2$ content: 30%, produced by Ishihara Sangyo Co., Ltd.) | Granular | 0.007 | 1.56 |
| Zirconia fine particles F | NZS-30A ($ZrO_2$ content: 30%, produced by Nissan Kagaku Kogyo Co., Ltd.) | Granular | 0.070 | 1.63 |
| Ceria fine particles G | Ceria-sol ($CeO_2$ content: 20%, produced by Nissan Kagaku Kogyo Co., Ltd.) | Granular | 0.010 | 1.46 |

TABLE 5

| Examples and Comparative Examples | Kind of core particles | Production of black non-magnetic composite particles Adhesion of colloid solution containing fine particles Fine particles adhered: Kind | Amount (part by weight) |
|---|---|---|---|
| Example 3 | Core particles 1 | Silicon oxide fine particles A | 25.0 |
| Example 4 | Core particles 2 | Silicon oxide fine particles A | 20.0 |
| Example 5 | Core particles 3 | Silicon oxide fine particles B | 10.0 |
| Example 6 | Core particles 4 | Silicon oxide fine particles C | 5.0 |
| Example 7 | Core particles 5 | Silicon oxide fine particles A | 25.0 |
| Example 8 | Core particles 6 | Silicon oxide fine particles A | 10.0 |
| Example 9 | Core particles 7 | Silicon oxide fine particles B | 5.0 |
| Example 10 | Core particles 8 | Silicon oxide fine particles C | 18.0 |
| Example 11 | Core particles 1 | Hydrated alumina fine particles D | 25.0 |
| Example 12 | Core particles 2 | Titania fine particles E | 10.0 |
| Example 13 | Core particles 3 | Zirconia fine particles F | 15.0 |
| Example 14 | Core particles 4 | Ceria fine particles G | 10.0 |
| Example 15 | Core particles 5 | Silicon oxide fine particles A | 15.0 |
| | | Hydrated alumina fine particles D | 10.0 |
| Example 16 | Core particles 6 | Silicon oxide fine particles A | 5.0 |
| | | Zirconia fine particles F | 10.0 |
| Comparative Example 1 | Core particles 1 | — | — |
| Comparative Example 2 | Core particles 1 | Silicon oxide fine particles A | 10.0 |
| Comparative Example 3 | Core particles 1 | Silicon oxide fine particles A | 5.0 |
| Comparative Example 4 | Core particles 1 | Silicon oxide fine particles A | 0.1 |
| Comparative Example 5 | Core particles 1 | Silicon oxide fine particles A | 10.0 |

TABLE 5-continued

| Examples and Comparative Examples | Production of black non-magnetic composite particles Adhesion of colloid solution containing fine particles: Edge runner treatment: Linear load (kg/cm) | Time ( min) | Amount of fine particles existing on core particle: Oxide (calculated as) | Amount (wt. %) |
|---|---|---|---|---|
| Example 3 | 60 | 30 | $SiO_2$ | 4.55 |
| Example 4 | 60 | 30 | $SiO_2$ | 3.69 |
| Example 5 | 45 | 60 | $SiO_2$ | 1.92 |
| Example 6 | 60 | 30 | $SiO_2$ | 0.98 |
| Example 7 | 75 | 20 | $SiO_2$ | 4.68 |
| Example 8 | 45 | 60 | $SiO_2$ | 1.92 |
| Example 9 | 60 | 30 | $SiO_2$ | 0.98 |
| Example 10 | 60 | 30 | $SiO_2$ | 3.35 |
| Exmaple 11 | 60 | 30 | $Al_2O_3$ | 4.58 |
| Example 12 | 45 | 30 | $TiO_2$ | 2.90 |
| Example 13 | 30 | 60 | $ZrO_2$ | 4.38 |
| Example 14 | 45 | 45 | $CeO_2$ | 1.94 |
| Example 15 | 60 | 30 | $SiO_2$ | 2.95 |
| | | | $Al_2O_3$ | 1.86 |
| Example 16 | 45 | 30 | $SiO_2$ | 0.96 |
| | | | $ZrO_2$ | 1.80 |
| Comparative 16 | 45 | 30 | $SiO_2$ | 0.96 |
| | | | $ZrO_2$ | 1.80 |
| Comparative Example 1 | — | — | — | — |
| Comparative Example 2 | 60 | 30 | $SiO_2$ | 1.95 |
| Comparative Example 3 | 60 | 30 | $SiO_2$ | 0.96 |
| Comparative Example 4 | 60 | 30 | $SiO_2$ | $2.0 \times 10^{-4}$ |
| Comparative Example 5 | 60 | 30 | $SiO_2$ | 1.94 |

TABLE 5-continued

| Examples and Comparative Examples | Production of black non-magnetic composite particles Coating with methyl hydrogen polysiloxane Methyl hydrogen polysiloxane Kind | Amount added (calculated as $SiO_2$) (part by weight) |
|---|---|---|
| Example 3 | TSF484 | 5.0 |
| Example 4 | TSF484 | 1.0 |
| Example 5 | TSF483 | 10.0 |
| Example 6 | TSF484 | 2.0 |
| Example 7 | TSF484 | 5.0 |
| Example 8 | TSF484 | 10.0 |
| Example 9 | TSF483 | 6.0 |
| Example 10 | TSF484 | 5.0 |
| Example 11 | TSF484 | 5.0 |
| Example 12 | TSF484 | 3.0 |
| Example 13 | TSF484 | 10.0 |
| Example 14 | TSF484 | 2.5 |
| Example 15 | TSF484 | 7.5 |
| Example 16 | TSF484 | 10.0 |
| Comparative Example 1 | TSF484 | 7.5 |
| Comparative Example 2 | — | — |
| Comparative Example 3 | TSF484 | 0.005 |
| Comparative Example 4 | TSF484 | 2.0 |
| Comparative Example 5 | TSF484 | 2.0 |

TABLE 5-continued

| Examples and Comparative Examples | Production of black non-magnetic composite particles Coating with methyl hydrogen polysiloxane Egde runner treatment Linear load (kg/cm) | Time (min) | Coating amount (calculated as $SiO_2$) (wt. %) |
|---|---|---|---|
| Example 3 | 60 | 30 | 4.91 |
| Example 4 | 75 | 20 | 1.00 |
| Example 5 | 45 | 45 | 10.15 |
| Example 6 | 60 | 45 | 2.01 |
| Example 7 | 60 | 60 | 4.99 |
| Example 8 | 60 | 30 | 9.97 |
| Example 9 | 60 | 30 | 5.89 |
| Example 10 | 60 | 30 | 5.00 |
| Example 11 | 45 | 45 | 4.90 |
| Example 12 | 60 | 30 | 2.93 |
| Example 13 | 30 | 30 | 9.13 |
| Example 14 | 45 | 60 | 2.38 |
| Example 15 | 60 | 30 | 7.01 |
| Example 16 | 30 | 60 | 9.32 |
| Comparative Example 1 | 45 | 60 | 7.54 |
| Comparative Example 2 | — | — | — |
| Comparative Example 3 | 60 | 30 | 0.005 |
| Comparative Example 4 | 60 | 30 | 1.96 |
| Comparative Example 5 | 60 | 30 | 1.95 |

TABLE 6

| Examples and Comparative Examples | Properties of black non-magnetic composite particles Average particle size (μm) | Aspect ratio (sphericity) (–) | Geometrical standard deviation (–) | BET specific surface area ($m^2/g$) | Mn content (wt. %) | Fluidity index (–) | Blackness (L* value) (–) | Volume resistivity (Ω · cm) |
|---|---|---|---|---|---|---|---|---|
| Example 3 | 0.32 | 1.3:1 | 1.49 | 7.8 | 11.9 | 49 | 22.9 | $2.3 \times 10^{10}$ |
| Example 4 | 0.19 | 1.3:1 | 1.41 | 10.5 | 14.7 | 50 | 24.8 | $1.1 \times 10^{10}$ |
| Example 5 | 0.29 | 7.3:1 | 1.38 | 63.5 | 15.7 | 55 | 26.9 | $9.5 \times 10^{9}$ |
| Example 6 | 0.20 | 6.7:1 | 1.41 | 25.9 | 11.9 | 59 | 25.5 | $8.6 \times 10^{9}$ |
| Example 7 | 0.32 | 1.3:1 | 1.49 | 8.9 | 11.6 | 51 | 23.5 | $5.4 \times 10^{10}$ |
| Example 8 | 0.19 | 1.3:1 | 1.41 | 11.2 | 13.0 | 53 | 25.6 | $3.6 \times 10^{10}$ |
| Example 9 | 0.29 | 7.3:1 | 1.38 | 58.5 | 14.1 | 56 | 27.3 | $2.0 \times 10^{10}$ |
| Example 10 | 0.20 | 6.7:1 | 1.41 | 21.4 | 11.5 | 61 | 25.3 | $1.2 \times 10^{10}$ |
| Example 11 | 0.32 | 1.3:1 | 1.49 | 8.3 | 11.7 | 51 | 22.8 | $1.6 \times 10^{10}$ |
| Example 12 | 0.19 | 1.3:1 | 1.42 | 12.3 | 14.7 | 53 | 24.9 | $1.2 \times 10^{10}$ |
| Example 13 | 0.28 | 7.3:1 | 1.38 | 62.8 | 15.6 | 56 | 26.8 | $9.6 \times 10^{9}$ |
| Example 14 | 0.20 | 6.7:1 | 1.41 | 26.9 | 11.8 | 55 | 25.3 | $8.3 \times 10^{9}$ |
| Example 15 | 0.32 | 1.3:1 | 1.48 | 9.6 | 11.6 | 59 | 23.4 | $1.7 \times 10^{10}$ |
| Example 16 | 0.19 | 1.3:1 | 1.40 | l0.6 | 13.1 | 58 | 25.5 | $2.1 \times 10^{10}$ |
| Comparative Example 1 | 0.32 | 1.3:1 | 1.48 | 3.0 | 12.2 | 29 | 23.4 | $3.9 \times 10^{8}$ |
| Comparative Example 2 | 0.32 | 1.3:1 | 1.48 | 15.3 | 12.8 | 34 | 23.1 | $5.6 \times 10^{7}$ |
| Comparative Example 3 | 0.32 | 1.3:1 | 1.48 | 14.8 | 13.0 | 34 | 23.3 | $1.3 \times 10^{8}$ |
| Comparative Example 4 | 0.32 | 1.3:1 | 1.49 | 11.1 | 12.8 | 30 | 23.1 | $5.6 \times 10^{7}$ |
| Comparative Example 5 | 0.33 | 1.3:1 | 1.48 | 7.8 | 12.6 | 34 | 23.3 | $1.3 \times 10^{8}$ |

TABLE 7

| | Production of black toner | | | | | | | | |
|---|---|---|---|---|---|---|---|---|---|
| | Black non-magnetic composite particles | | Binder resin | | Properties of black toner | | | | |
| Examples | Kind | Amount blended (part by weight) | Kind | Amount blended (part by weight) | Average particle size (μm) | Dispersibility (–) | Fluidity index (–) | Blackness (L* value) (–) | Volume resistivity (Ω · cm) |
| Example 17 | Example 3 | 15 | Styrene-acryl copolymer resin | 85 | 9.8 | 5 | 86 | 23.4 | $8.0 \times 10^{14}$ |
| Example 18 | Example 4 | 15 | Styrene-acryl copolymer resin | 85 | 8.6 | 5 | 86 | 25.9 | $6.6 \times 10^{14}$ |
| Example 19 | Example 5 | 15 | styrene-acryl copolymer resin | 85 | 9.5 | 4 | 75 | 27.0 | $8.3 \times 10^{14}$ |
| Example 20 | Example 6 | 15 | Styrene-acryl copolymer resin | 85 | 9.3 | 4 | 78 | 26.5 | $9.2 \times 10^{14}$ |
| Example 21 | Example 7 | 15 | Styrene-acryl copolymer resin | 85 | 10.0 | 5 | 83 | 25.1 | $1.5 \times 10^{15}$ |
| Example 22 | Example 8 | 15 | Styrene-acryl copolymer resin | 85 | 8.7 | 5 | 89 | 26.8 | $2.5 \times 10^{15}$ |
| Example 23 | Example 9 | 15 | Styrene-acryl copolymer resin | 85 | 9.7 | 5 | 81 | 28.0 | $7.6 \times 10^{15}$ |
| Example 24 | Example 10 | 15 | Styrene-acryl copolymer resin | 85 | 8.9 | 5 | 81 | 26.8 | $5.3 \times 10^{15}$ |
| Example 25 | Example 11 | 15 | Styrene-acryl copolymer resin | 85 | 9.9 | 4 | 81 | 23.3 | $8.2 \times 10^{14}$ |
| Example 26 | Example 12 | 15 | Styrene-acryl copolymer resin | 85 | 10.0 | 4 | 83 | 25.6 | $7.6 \times 10^{14}$ |
| Example 27 | Example 13 | 15 | Styrene-acryl copolymer resin | 85 | 10.2 | 4 | 81 | 26.9 | $9.1 \times 10^{14}$ |
| Example 28 | Example 14 | 15 | Styrene-acryl copolymer resin | 85 | 9.8 | 4 | 85 | 26.6 | $1.0 \times 10^{15}$ |
| Example 29 | Example 15 | 15 | Styrene-acryl copolymer resin | 85 | 10.1 | 5 | 83 | 25.9 | $2.1 \times 10^{15}$ |
| Example 30 | Example 16 | 15 | Styrene-acryl copolymer resin | 85 | 10.3 | 5 | 86 | 26.7 | $1.6 \times 10^{15}$ |

TABLE 8

| Comparative Examples | Production of black toner | | | |
|---|---|---|---|---|
| | Black particles | | Binder resin | |
| | Kind | Amount blended (part by weight) | Kind | Amount blended (part by weight) |
| Comparative Example 6 | Core particles 1 | 15 | Styrene-acryl copolymer resin | 85 |
| Comparative Example 7 | Core particles 2 | 15 | Styrene-acryl copolymer resin | 85 |
| Comparative Example 8 | Core particles 3 | 15 | Styrene-acryl copolymer resin | 85 |
| Comparative Example 9 | Core particles 4 | 15 | Styrene-acryl copolymer resin | 85 |
| Comparative Example 10 | Comparative Example 1 | 15 | Styrene-acryl copolymer resin | 85 |
| Comparative Example 11 | Comparative Example 2 | 15 | Styrene-acryl copolymer resin | 85 |
| Comparative Example 12 | Comparative Example 3 | 15 | Styrene-acryl copolymer resin | 85 |
| Comparative Example 13 | Comparative Example 4 | 15 | Styrene-acryl copolymer resin | 85 |
| Comparative Example 14 | Comparative Example 5 | 15 | Styrene-acryl copolymer resin | 85 |

| | Properties of black toner | | |
|---|---|---|---|
| | Average particle size (μm) | Dispersibility (–) | Fluidity index (–) |
| Comparative Example 6 | 9.9 | 3 | 54 |
| Comparative Example 7 | 10.1 | 3 | 49 |
| Comparative Example 8 | 8.9 | 2 | 51 |
| Comparative Example 9 | 9.3 | 2 | 53 |
| Comparative | 9.5 | 2 | 67 |

TABLE 8-continued

| Comparative Examples | | | |
|---|---|---|---|
| Example 10 | | | |
| Comparative Example 11 | 8.8 | 2 | 65 |
| Comparative Example 12 | 10.0 | 2 | 63 |
| Comparative Example 13 | 9.3 | 2 | 61 |
| Comparative Example 14 | 8.9 | 2 | 61 |

| | Blackness (L* value) (–) | Volume resistivity (Ω·cm) |
|---|---|---|
| Comparative Example 6 | 24.1 | $2.5 \times 10^{12}$ |
| Comparative Example 7 | 25.6 | $3.5 \times 10^{12}$ |
| Comparative Example 8 | 27.6 | $3.7 \times 10^{12}$ |
| Comparative Example 9 | 26.1 | $4.1 \times 10^{12}$ |
| Comparative Example 10 | 21.0 | $4.1 \times 10^{12}$ |
| Comparative Example 11 | 20.8 | $1.9 \times 10^{12}$ |
| Comparative Example 12 | 21.6 | $3.7 \times 10^{12}$ |
| Comparative Example 13 | 24.4 | $1.7 \times 10^{12}$ |
| Comparative Example 14 | 24.3 | $4.9 \times 10^{12}$ |

TABLE 9

| Examples | Production of black toner | | | |
|---|---|---|---|---|
| | Composite particles | | | |
| | Black particles | | Binder resin | |
| | Kind | Amount blended (part by weight) | Kind | Amount blended (part by weight) |
| Example 31 | Core particles 1 | 15 | Styrene-acryl copolymer resin | 85 |
| Example 32 | Core particles 2 | 15 | styrene-acryl copolymer resin | 85 |
| Example 33 | Core particles 3 | 15 | styrene-acryl copolymer resin | 85 |
| Example 34 | Core particles 4 | 15 | styrene-acryl copolymer resin | 85 |
| Example 35 | Core particles 5 | 15 | styrene-acryl copolymer resin | 85 |
| Example 36 | Core particles 6 | 15 | styrene-acryl copolymer resin | 85 |
| Example 37 | Core particles 7 | 15 | styrene-acryl copolymer resin | 85 |
| Example 38 | Core particles 8 | 15 | styrene-acryl copolymer resin | 85 |
| Example 39 | Core particles 1 | 15 | styrene-acryl copolymer resin | 85 |
| Example 40 | Core particles 2 | 15 | styrene-acryl copolymer resin | 85 |
| Example 41 | Core particles 3 | 15 | styrene-acryl copolymer resin | 85 |
| Example 42 | Core particles 4 | 15 | styrene-acryl copolymer resin | 85 |
| Example 43 | Core particles 5 | 15 | styrene-acryl copolymer resin | 85 |
| Example 44 | Core | 15 | styrene-acryl | 85 |

TABLE 9-continued

| Examples | Production of black toner | |
|---|---|---|
| | particles 6 | copolymer resin |
| | Black non-magnetic composite particles adhered | |
| | Kind | Amount blended (part by weight) |
| Example 31 | Example 3 | 1.0 |
| Example 32 | Example 4 | 2.0 |
| Example 33 | Example 5 | 0.5 |
| Example 34 | Example 6 | 2.0 |
| Example 35 | Example 7 | 1.0 |
| Example 36 | Example 8 | 0.5 |
| Example 37 | Example 9 | 1.5 |
| Example 38 | Example 10 | 2.0 |
| Example 39 | Example 11 | 1.0 |
| Example 40 | Example 12 | 2.0 |
| Example 41 | Example 13 | 0.5 |
| Example 42 | Example 14 | 2.5 |
| Example 43 | Example 15 | 1.0 |
| Example 44 | Example 16 | 1.5 |

| | Average particle size (μm) | Fluidity index (–) |
|---|---|---|
| Example 31 | 10.0 | 76 |
| Example 32 | 10.2 | 76 |
| Example 33 | 10.3 | 78 |
| Example 34 | 10.1 | 76 |
| Example 35 | 9.8 | 79 |
| Example 36 | 9.9 | 79 |
| Example 37 | 10.2 | 80 |
| Example 38 | 10.0 | 79 |
| Example 39 | 10.1 | 78 |
| Example 40 | 9.8 | 79 |
| Example 41 | 9.6 | 77 |
| Example 42 | 10.3 | 76 |
| Example 43 | 10.2 | 78 |
| Example 44 | 10.3 | 78 |

| | Blackness (L* value) (–) | Volume resistivity (Ω·cm) |
|---|---|---|
| Example 31 | 23.2 | 9.1 × 1014 |
| Example 32 | 25.6 | 7.6 × 1014 |
| Example 33 | 26.4 | 6.8 × 1014 |
| Example 34 | 26.3 | 9.8 × 1014 |
| Example 35 | 25.0 | 8.6 × 1015 |
| Example 36 | 26.3 | $6.9 \times 10^{14}$ |
| Example 37 | 27.2 | $1.3 \times 10^{15}$ |
| Example 38 | 26.4 | $1.6 \times 10^{15}$ |
| Example 39 | 23.1 | $6.1 \times 10^{14}$ |
| Example 40 | 25.7 | $7.8 \times 10^{14}$ |
| Example 41 | 26.1 | $5.6 \times 10^{14}$ |
| Example 42 | 26.1 | $8.6 \times 10^{14}$ |
| Example 43 | 25.0 | $2.3 \times 10^{15}$ |
| Example 44 | 26.2 | $1.8 \times 10^{15}$ |

TABLE 10

| Examples | Production of black toner | | | |
|---|---|---|---|---|
| | Composite particles | | Black non-magnetic composite particles adhered | |
| | Kind | Amount blended (part by weight) | Kind | Amount blended (part by weight) |

TABLE 10-continued

| Examples | | | | |
|---|---|---|---|---|
| Example 45 | Example 17 | 100 | Example 3 | 1.0 |
| Example 46 | Example 18 | 100 | Example 4 | 0.5 |
| Example 47 | Example 19 | 100 | Example 5 | 1.0 |
| Example 48 | Example 20 | 100 | Example 6 | 2.0 |
| Example 49 | Example 21 | 100 | Example 7 | 1.0 |
| Example 50 | Example 22 | 100 | Example 8 | 1.5 |
| Example 51 | Example 23 | 100 | Example 9 | 2.0 |
| Example 52 | Example 24 | 100 | Example 10 | 1.0 |
| Example 53 | Example 25 | 100 | Example 11 | 1.0 |
| Example 54 | Example 26 | 100 | Example 12 | 2.0 |
| Example 55 | Example 27 | 100 | Example 13 | 1.5 |
| Example 56 | Example 28 | 100 | Example 14 | 0.8 |
| Example 57 | Example 29 | 100 | Example 15 | 1.0 |
| Example 58 | Example 30 | 100 | Example 16 | 2.0 |

| | Properties of black toner | |
|---|---|---|
| | Average particle size (μm) | Fluidity index (–) |
| Example 45 | 10.3 | 86 |
| Example 46 | 10.4 | 87 |
| Exarnple 47 | 10.2 | 86 |
| Example 48 | 10.5 | 86 |
| Example 49 | 10.6 | 88 |
| Example 50 | 10.3 | 90 |
| Example 51 | 9.9 | 90 |
| Example 52 | 10.4 | 89 |
| Example 53 | 10.0 | 86 |
| Example 54 | 10.1 | 87 |
| Example 55 | 9.9 | 87 |
| Example 56 | 9.5 | 88 |
| Example 57 | 10.3 | 89 |
| Example 58 | 10.1 | 89 |

| | Blackness (L* value) (–) | Volume resistivity (Ω · cm) |
|---|---|---|
| Example 45 | 23.3 | $2.6 \times 10^{15}$ |
| Example 46 | 25.8 | $3.6 \times 10^{15}$ |
| Example 47 | 26.6 | $1.3 \times 10^{15}$ |
| Example 48 | 26.5 | $4.2 \times 10^{15}$ |
| Example 49 | 25.2 | $5.6 \times 10^{15}$ |
| Example 50 | 26.5 | $7.2 \times 10^{15}$ |
| Example 51 | 26.9 | $6.3 \times 10^{15}$ |
| Example 52 | 26.3 | $8.3 \times 10^{15}$ |
| Example 53 | 23.2 | $3.8 \times 10^{15}$ |
| Example 54 | 25.9 | $4.1 \times 10^{15}$ |
| Example 55 | 26.3 | $1.6 \times 10^{15}$ |
| Example 56 | 26.2 | $2.1 \times 10^{15}$ |
| Example 57 | 25.1 | $6.3 \times 10^{15}$ |
| Example 58 | 26.3 | $7.9 \times 10^{15}$ |

TABLE 11

| Examples | Production of black toner | | | |
|---|---|---|---|---|
| | Black non-magnetic particles | | Binder resin | |
| | Kind | Amount blended (part by weight) | Kind | Amount blended (part by weight) |
| Example 59 | Core particles 1 | 7.0 | Styrene-acryl copolymer resin | 85 |
| | Example 3 | 8.0 | | |
| Example 60 | Core particles 2 | 5.0 | styrene-acryl copolymer | 85 |

TABLE 11-continued

| Examples | | | | |
|---|---|---|---|---|
| | Example 4 | 10.0 | resin | |
| Example 61 | Core particles 3 | 6.5 | styrene-acryl copolymer | 85 |
| | Example 5 | 8.5 | resin | |
| Example 62 | Core particles 4 | 2.5 | styrene-acryl copolymer | 85 |
| | Example 6 | 12.5 | resin | |

| | Properties of black toner | |
|---|---|---|
| | Average particle size (μm) | Fluidity index (–) |
| Example 59 | 10.0 | 32 |
| Example 60 | 10.2 | 81 |
| Example 61 | 10.3 | 83 |
| Example 62 | 10.0 | 83 |

| | Blackness (L* value) (–) | Volume resistivity Ω·cm) |
|---|---|---|
| Example 59 | 23.4 | $7.2 \times 10^{14}$ |
| Example 60 | 25.9 | $9.2 \times 10^{14}$ |
| Example 61 | 26.7 | $6.4 \times 10^{14}$ |
| Example 62 | 26.3 | $9.1 \times 10^{14}$ |

TABLE 12

| Examples | Production of black toner Composite particles | | | |
|---|---|---|---|---|
| | Black non-magnetic particles | | Binder resin | |
| | Kind | Amount blended (part by weight) | Kind | Amount blended (part by weight) |
| Example 63 | Core particles 5 | 12.5 | Styrene-acryl copolymer resin | 85 |
| | Example 7 | 2.5 | | |
| Example 64 | Core particles 6 | 10.0 | Styrene-acryl copolymer resin | 85 |
| | Example 8 | 5.0 | | |
| Example 65 | Core particles 7 | 7.5 | Styrene-acryl copolymer resin | 85 |
| | Example 9 | 7.5 | | |
| Example 66 | Core particles 8 | 12.5 | Styrene-acryl copolymer resin | 85 |
| | Example 10 | 2.5 | | |
| Example 67 | Core particles 1 | 10.0 | Styrene-acryl copolymer resin | 85 |
| | Example 11 | 5.0 | | |
| Example 68 | Core particles 2 | 2.5 | Styrene-acryl copolymer resin | 85 |
| | Example 12 | 12.5 | | |
| Example 69 | Core particles 3 | 12.5 | Styrene-acryl copolymer resin | 85 |
| | Example 13 | 2.5 | | |
| Example 70 | Core particles 4 | 10.0 | Styrene-acryl copolymer resin | 85 |
| | Exarnple 14 | 5.0 | | |
| Example 71 | Core particles 5 | 7.5 | Styrene-acryl copolymer resin | 85 |
| | Example 15 | 7.5 | | |
| Example 72 | Core particles 6 | 12.5 | Styrene-acryl copolymer resin | 85 |
| | Example 16 | 2.5 | | |

TABLE 12-continued

Examples

| | Production of black toner Black non-rnagnetic particles adhered | | Properties of black toner |
|---|---|---|---|
| | Kind | Amount blended (part by weight) | Average particle size ($\mu$m) |
| Example 63 | Example 3 | 1.0 | 10.4 |
| Example 64 | Example 4 | 2.0 | 9.6 |
| Example 65 | Example 5 | 1.0 | 10.0 |
| Example 66 | Example 6 | 1.5 | 10.1 |
| Example 67 | Example 7 | 1.0 | 10.1 |
| Example 68 | Example 8 | 2.0 | 9.9 |
| Example 69 | Example 9 | 2.0 | 10.0 |
| Example 70 | Example 10 | 1.6 | 10.3 |
| Example 71 | Example 11 | 2.0 | 9.8 |
| Example 72 | Example 12 | 1.5 | 10.1 |

| | Properties of black toner | | |
|---|---|---|---|
| | Fluidity index (–) | Blackness (L* value) (–) | Volume resistivity (Ω·cm) |
| Example 63 | 86 | 25.3 | $2.8 \times 10^{15}$ |
| Example 64 | 88 | 26.6 | $8.6 \times 10^{15}$ |
| Example 65 | 88 | 27.0 | $6.6 \times 10^{15}$ |
| Example 66 | 87 | 26.2 | $5.1 \times 10^{15}$ |
| Example 67 | 83 | 23.2 | $9.3 \times 10^{14}$ |
| Example 68 | 84 | 25.6 | $1.8 \times 10^{15}$ |
| Example 69 | 86 | 26.5 | $9.9 \times 10^{14}$ |
| Example 70 | 83 | 26.0 | $7.8 \times 10^{14}$ |
| Example 71 | 86 | 25.4 | $1.3 \times 10^{15}$ |
| Example 72 | 89 | 26.7 | $3.1 \times 10^{15}$ |

What is claimed is:

1. Black non-magnetic composite particles for black toner, comprising:

black hematite particles or black iron oxide hydroxide particles as core particles:

fine particles which are adhered or exist on at least a part of the surface of each black hematite particle or black iron oxide hydroxide particle, and comprise oxides, oxide hydroxides or oxides and oxide hydroxides composed of at least one element selected from the group consisting of Si, Zr, Ti, Al and Ce; and a methyl hydrogen polysiloxane coating layer formed on said fine particles or said fine particles and the exposed surface of the core particle, in an amount of 0.1 to 50% by weight, calculated as $SiO_2$, based on the weight of the core particles on the surfaces of which said fine particles are adhered or exist, the average particle size of said black non-magnetic composite particles being 0.08 to 1.0 $\mu$m.

2. Black non-magnetic composite particles according to claim 1, wherein at least a part of the surface of said black hematite particle or black iron oxide hydroxide particle as core particle is coated with at least one compound selected from the group consisting of hydroxides of aluminum, oxides of aluminum, hydroxides of silicon and oxides of silicon.

3. Black non-magnetic composite particles according to claim 1, wherein the amount of said fine particles adhered or existing on the surface of each core particle is 0.5 to 50% by weight, calculated as $SiO_2$, $ZrO_2$, $TiO_2$, $Al_2O_3$ or $CeO_2$, based on the weight of the core particles.

4. Black non-magnetic composite particles according to claim 1, which further have a geometrical standard deviation of particle size of 1.01 to 2.0, a BET specific surface area of 0.5 to 100 $m^2/g$, and a fluidity index of 47 to 80.

5. Black non-magnetic composite particles according to claim 1, which further have a blackness (L* value) of 18.0 to 30.0 and a volume resistivity of not less than $1.0\times10^8$ Ω·cm.

6. Black non-magnetic composite particles according to claim 1, wherein said core particles have an average particle size of 0.055 to 0.95 $\mu$m, a geometrical standard deviation of particle size distribution of 1.01 to 2.0, a BET specific surface area of 0.5 to 90 $m^2/g$, and a fluidity index of 25 to 43.

7. Black non-magnetic composite particles according to claim 1, wherein said core particles have a blackness (L* value) of 18 to 30 and a volume resistivity of $5.0\times10^6$ to $8.0\times10^7$ Ω·cm.

8. Black non-magnetic composite particles according to claim 1, wherein the particle size of the fine particles is 0.001 to 0.05 $\mu$m.

9. Black non-magnetic composite particles according to claim 1, wherein said methyl hydrogen polysiloxane is represented by the following general formula (1):

$$(CH_3HSiO)_n((CH_3)_3SiO_{1/2})_2 \quad (1)$$

wherein n is 10 to 830.

10. Black non-magnetic composite particles according to claim 2, wherein the coating amount of said at least one compound selected from the group consisting of hydroxides of aluminum, oxides of aluminum, hydroxides of silicon and oxides of silicon, is 0.01 to 50% by weight, calculated as Al or $SiO_2$, based on the weight of said core particles.

11. A black toner comprising composite particles which comprise:

the black non-magnetic composite particles set forth in claim 1; and a binder resin.

12. A black toner according to claim 11, which further have a fluidity index of 70 to 100.

13. A black toner according to claim 11, which further have a volume resistivity of not less than $1.0\times10^{13}$ Ω·cm and less than $1.0\times10^{17}$ Ω·cm.

14. A black toner according to claim 11, which further have a blackness (L* value) of 16.0 to 40.0.

15. A black toner according to claim 11, wherein the black non-magnetic composite particles exist inside the composite particle and at least a part of said black non-magnetic composite particles is exposed to the surface of the composite particle.

16. A black toner according to claim 15, wherein the content of said binder resin is 200 to 3,500 parts by weight based on 100 parts by weight of said black non-magnetic composite particles.

17. A black toner according to claim 15, wherein said composite particles contain carbon black fine particles therewithin.

18. A black toner according to claim 11, wherein the black non-magnetic composite particles exist in the surface of said composite particle.

19. A black toner according to claim 9, wherein the amount of the black non-magnetic composite particles is 0.1 to 9.0 parts by weight based on 100 parts by weight of the composite particles.

20. A black toner according to claim 18, wherein said composite particles contain carbon black fine particles therewithin.

21. A black toner according to claim 11, wherein a part of the black non-magnetic composite particles exist inside the composite particle in which at least a part of the black non-magnetic composite particles is exposed to the surface of the composite particle, and a part of the black non-magnetic composite particles exist in the surface of said composite particle.

22. A black toner according to claim 21, wherein the content of the binder resin is 200 to 3,500 parts by weight based on 100 parts by weight of said black non-magnetic composite particles existing inside the composite particle, and the amount of the black non-magnetic composite particles existing in the surface thereof is 0.1 to 9.0 parts by weight based on 100 parts by weight of the composite particles.

23. A black toner according to claim 21, wherein said composite particles further contain carbon black fine particles therewithin.

* * * * *